US008690149B2

(12) United States Patent
Eschlbeck et al.

(10) Patent No.: US 8,690,149 B2
(45) Date of Patent: Apr. 8, 2014

(54) DEVICE AND METHOD FOR RECEIVING, HOLDING AND/OR HANDLING TWO-DIMENSIONAL OBJECTS

(75) Inventors: Richard Eschlbeck, Vogtareuth (DE); Peter Kirschner, Soechtenau (DE); Kai Wegener, Munich (DE); Dennis Fritsch, Munich (DE)

(73) Assignee: Krones AG, Neutraubling (DE)

( * ) Notice: Subject to any disclaimer, the term of this patent is extended or adjusted under 35 U.S.C. 154(b) by 0 days.

(21) Appl. No.: 13/346,264

(22) Filed: Jan. 9, 2012

(65) Prior Publication Data

US 2012/0181740 A1 Jul. 19, 2012

(30) Foreign Application Priority Data

Jan. 18, 2011 (DE) ..... 10 2011 008 848
Oct. 19, 2011 (DE) ..... 10 2011 084 830

(51) Int. Cl.

| | |
|---|---|
| ***B65H 3/08*** | (2006.01) |
| ***B65H 3/40*** | (2006.01) |
| ***B65H 3/12*** | (2006.01) |
| ***B65H 3/14*** | (2006.01) |
| ***B65H 3/34*** | (2006.01) |

(52) U.S. Cl.
USPC ..... 271/91; 271/90; 271/95; 271/98; 271/104; 414/797

(58) Field of Classification Search
USPC ..... 271/91, 92, 90, 106, 98, 11, 104, 95; 414/797
See application file for complete search history.

(56) References Cited

U.S. PATENT DOCUMENTS

| | | | | |
|---|---|---|---|---|
| 2,941,799 | A | 6/1960 | Reincke | 271/27 |
| 5,033,730 | A * | 7/1991 | Davies et al. | 271/106 |
| 5,083,763 | A | 1/1992 | Hartta | |
| 5,415,388 | A * | 5/1995 | Torisawa et al. | 271/91 |
| 5,433,426 | A * | 7/1995 | Bond | 271/92 |
| 5,568,918 | A * | 10/1996 | Torisawa et al. | 271/91 |
| 5,876,031 | A * | 3/1999 | Ohkoda et al. | 271/14 |
| 6,010,125 | A * | 1/2000 | Nakajima | 271/11 |
| 6,886,827 | B2 | 5/2005 | Dachtler | 271/106 |
| 2006/0045721 | A1 * | 3/2006 | de Koning | 414/751.1 |

FOREIGN PATENT DOCUMENTS

| | | | | |
|---|---|---|---|---|
| EP | 0 639 519 | A1 | 2/1995 | |
| EP | 1 215 148 | A1 | 6/2002 | |
| EP | 1382559 | | 1/2004 | |
| EP | 1864922 | B1 | 12/2007 | |
| JP | 61136839 | A * | 6/1986 | B65H 3/08 |
| JP | 61-166 441 | A | 7/1986 | |
| JP | 2010 195 535 | A | 9/2010 | |

* cited by examiner

*Primary Examiner* — Patrick Cicchino
(74) *Attorney, Agent, or Firm* — Davidson, Davidson & Kappel, LLC

(57) ABSTRACT

A receiving, holding and/or handling device for two-dimensional objects, with at least two controllable suction grippers. The suction grippers are arranged and connected to free ends of movable cantilever arms, which are elastically deformable at least in some sections. The cantilever arm are mounted and supported on a bridge. The cantilever arms each include at least one lower pull and one upper pull which meet at the free end of the cantilever arm and are connected there. An actuating device is assigned to the upper pull. The actuating device generates a pulling force with at least one horizontal direction component which is approximately parallel to the longitudinal extension direction of the cantilever arm. A method is also disclosed.

17 Claims, 17 Drawing Sheets

DEVICE AND METHOD FOR RECEIVING, HOLDING AND/OR HANDLING TWO-DIMENSIONAL OBJECTS

This claims the benefit of German Patent Applications DE 10 2011 008 848.2, filed Jan. 18, 2011 and DE 10 2011 084 830.4, filed Oct. 19, 2011, both of which are hereby incorporated by reference herein.

The present invention relates to a receiving, holding and/or handling device for two-dimensional objects with at least two controllable suction grippers. A method for receiving, holding and/or handling two-dimensional objects with at least two controllable suction grippers.

BACKGROUND

During the processing of products and general cargo, especially during packaging, the products or cargo are often stacked in several layers one above the other. Intermediate layers are often inserted between the several layers of products or cargo. These intermediate layers are usually two-dimensional objects. The term two-dimensional object refers to layers of material, whereby the thickness of the material is negligible in comparison to the length and width of the material. The term two-dimensional object especially refers to intermediate layers made from film, paper or any other material with similar properties, especially to any flexible material with a negligible thickness. Such two-dimensional objects or plates may for example be formed by cardboard intermediate layers, plastic intermediate layers, twin wall sheets, sheets of corrugated cardboard, etc., either made from cardboard or plastic material. It is often problematic to raise such two-dimensional objects or stacked plates individually, because the objects or plates tend to stick to each other. The unwanted sticking effects are especially due to adhesion forces or mechanical fiber entanglement or low pressure attachment. These attachment forces have to be reduced or rendered ineffective during the lifting of the individual sheets or plates from a stack. Faster cycle times of gripping and lifting devices lead to more pronounced effects of these unwanted adhesion phenomena. To avoid or at least reduce the sticking of the plates, suitable brush elements can be used. When the uppermost plate is lifted, the plate under is retained by these brush elements. In practice it has been found that lifting and bending the lateral areas of the uppermost plate can be used as an effective measure to prevent the unwanted effect that the plate below is also dragged along. Another measure to avoid the problems mentioned above may be the use of frame magazines with a pre-separation of the plates.

EP 0 639 519 A1 shows a separation device for sheet or plate material with a plurality of vertically-oriented vacuum grippers. The vacuum grippers contact the uppermost plate for lifting. A peripherally arranged vacuum gripper is swivel-mounted and/or the support of the peripherally arranged vacuum gripper is displaceable in a horizontal direction. The peripherally arranged vacuum gripper can bend the peripheral area of the plate before the whole device is lifted.

A device for separating flexible plate-like objects such as metal plates by means of suction carriers, which are also called suction grippers, is also known from EP 1 215 148 A1. The majority of vacuum grippers are associated with peripherally located so-called separation suckers. The separation suckers are pivotable about an articulated joint by a small amount compared to the suction carriers working in a vertical orientation. The separation suckers can lift the peripheral areas of the uppermost plate from the underlying plate and can bend this peripheral area upwards.

EP 1864922 B1 discloses an apparatus and method for lifting an uppermost plastic plate or sheet from a stack of plates by means of suction grippers. The suction grippers are put onto the uppermost plastic plate. Then vacuum is applied and the uppermost plate is lifted from the stack. To prevent a sticking of the uppermost plate to the plate below, the lifted plastic plate is initially lifted parallel to the stack and then subjected to a two-way bending. The disclosed device for lifting the uppermost plastic plate from the plate stack includes a vertically movable carrier with suction grippers mounted thereon. The suction grippers can be connected to a vacuum source. On the carrier the suction grippers are arranged in pairs of external and internal suction grippers. The inner suction grippers can be temporarily connected to a vacuum source. The outer suction grippers can be temporarily and alternately connected to a vacuum source and a compressed air supply via a switching valve.

SUMMARY OF THE INVENTION

It is an object of the present invention to provide a reliable working device and a corresponding method for receiving, holding and/or handling two-dimensional objects by controllable suction grippers. The suction grippers should allow the lifting of individual two-dimensional objects like plates or something similar from stacks without requiring any additional helping means. Helpings means are for example magazines for the intermediate layers comprising brush elements and/or a pre-separation system or comprising other retaining systems for the underlying two-dimensional objects. The device should lift the uppermost plate without the underlying object or sheet being pulled along and/or without shifting the underlying object. For industrial applications it is of particular interest that high cycle times can be realized without any implication on the precision of the handling. Additionally, the device and the appropriate method should be economically feasible.

The present invention provides a receiving, holding and/or handling device for two-dimensional, sheet-like objects with at least two controllable suction grippers. The two or more suction grippers are each mounted to free ends of cantilever arms. The cantilever arms are movable and elastic at least in some sections or the cantilever arms are movable by articulated movements. The cantilever arms are mounted on a bridge and/or supported on a bridge. The suction grippers are preferably connected to the cantilever arms in a way that they cannot swivel in any arbitrary direction. Instead the suspension grippers have to perform their linear and pivoting movements in conjunction with the elastic and/or articulated movable cantilever arms. The cantilever arms are typically arranged symmetrically and wing-like. They each comprise at least one lower pull and one upper pull that meet at the free end of the cantilever arm. At the meeting point the upper and the lower pull are either connected in a substantially rigid connection, which is not movable in an articulated movement. For instance the upper and the lower pull are just supported at the meeting point in a so called flying mount. Additionally the respective suction gripper is connected to the cantilever arm at this meeting point. Alternatively this anchorage can also be rigid and not articulated. The anchorage of the suction grippers can also show some slightly elastic properties depending on the elastic properties of the upper pull and the lower pull.

An alternative embodiment may provide that the connection between the upper pull and the lower pull at the free end of the cantilever arm is formed bendable or articulated. In this embodiment, however, it is necessary that the suction gripper is either fixed to the upper pull or to the lower pull in such a way that the suction gripper is not articulately mounted at this point but at best only marginally elastically movable. Otherwise the precise control of the orientation of the suction grippers would be significantly impaired due to kinematic indeterminacy. Thus, the suction gripper is largely fixed rigidly to the lower pull. Typically the suction gripper is fixed to the lower pull in a rectangular orientation. Meanwhile the connection between the upper pull and the lower pull and/or between the upper pull and the encasing of the suction gripper can be constructed articulated or bendable.

In the area of the bridge the upper pull and the lower pull may optionally be mounted at a distance from each other. The lower pull is usually connected to the bridge at a defined position. A suitable actor, especially a tensioning means or pulling means, is associated with the upper pull. The actuator generates a variably controllable traction force or pulling force with at least one horizontal direction component, which is approximately parallel to the longitudinal direction of extension of the respective cantilever arm. Especially this actuator can be formed by a suitable pulling device such as a linear drive or the like. However, other fundamentally different operating principles can also be used, such as rotary drives. Rotary drives have pulling means that generate a pulling force in the desired direction. Pneumatic or hydraulic servo drives or adjustment cylinders are especially suitable linear drives. The pneumatic or hydraulic servo drives or adjustment cylinders can be designed as single acting or double acting. The required pulling force for the deformation of the cantilever arms, which elastically press back into their initial position, can optionally be applied by means of a suitable mechanical mechanism using a pressure cylinder.

Besides the aforementioned connection of separate lower pulls of two symmetrically arranged cantilever arms to the centrally located bridge other variations are possible. One of the other embodiments is provided with a single continuous lower pull extending along the two symmetrically arranged cantilever arms. The single continuous lower pull is either connected to the bridge or is supported on the bridge in a so called flying mount. In a flying mount the upper pull is just supported on the bridge during the upward movement of the suction grippers, whereby a convex curvature of the lower pull is performed. In the embodiment with the so called flying mount it may be sensible to ensure an exactly synchronous deflection of the actuators, servo cylinder etc. which are responsible for the deflection movements of the cantilever arms. This ensures that the pair of cantilever arms is not asymmetrically deformed or makes an evasive maneuver in one of the two longitudinal directions of the cantilever arms. An exact positioning of the suction gripper would thus be difficult. These problems do not occur when the lower pulls or the single continuous lower pull are connected by a central anchorage. The two cantilever arms are basically independently controllable and deformable without any negative impact on the positioning control of the suction grippers.

The device according to the invention allows a motion control of two or more suction grippers. This motion control is also known as "Fin-Ray"-principle. The trajectories of the suction grippers allow the lifting of plates, sheets or other two-dimensional objects from stacks. The objects are initially lifted peripherally, whereby the center area of the two-dimensional object is not yet removed from the underlying surface. However, the removal of the peripheral areas prevents the undesirable sticking-effects. The two-dimensional object can subsequently be lifted completely, without the danger that the underlying object is pulled along, moved sideways or influenced in any other undesirable way. Optionally the suction gripper simultaneously swings back into its original vertical position while the two-dimensional object is lifted. Likewise, it is also possible; to lift the two-dimensional object from the stack immediately after the suction gripper has been lifted, without the suction grippers first swinging back into their original vertical position.

According to a first embodiment of the invention the relatively rigid connection between upper pull, lower pull and suction gripper allows a desired and preferred trajectory of the suction gripper. When seen in a side view the trajectory of the suction grippers resembles a dynamic upward and downward movement of wings. To achieve these trajectories, whereby the cantilever arms are deformed over their entire length, it might be necessary that the connective joints between upper pull and lower pull as well as the connective joints between cantilever arm and suction gripper are not constructed articulated or bendable. Instead it can be useful to use rigid connections or connective joints that are elastic only within certain limits. With appropriate dimensioning of the elasticities of the individual elements of the cantilever arms, the suction grippers can describe an arcuate trajectory when the actuating means are operated, which are associated with the upper pulls of the cantilever arms. In this embodiment the suction grippers are nearly vertically aligned in a first position. Simultaneously the suction grippers are adjusted angularly. Thereby the central area of each lifted two-dimensional object is drawn up against the bottom side of the bridge. Meanwhile the peripheral areas are lifted from the stack by the suction grippers, whereby the lower bases of the suction grippers rotate outwards.

According to an alternative embodiment, at least one of the two connections between the suction gripper and the upper pull or the lower pull are formed flexible or articulated. Thereby a modified deformation behavior of the cantilever arms, and thus a modified trajectory of the suction grippers can be realized. In a side view the trajectory of the suction grippers may also resemble the dynamic upward and downward movements of wings, if necessary showing a greater curvature in the direction of the suction grippers. According to this embodiment the suction grippers are nearly vertically aligned in a first position. With appropriate dimensioning of the elasticities of the individual elements of the cantilever arms, the suction grippers can describe an arcuate trajectory when the actuating means are operated. The actuating means are associated with the upper pulls of the cantilever arms. Simultaneously the suction grippers are adjusted angularly. Thereby the central area of each lifted two dimensional object is drawn up against the bottom side of the bridge. Meanwhile the peripheral areas are lifted from the stack by the suction grippers, the lower bases of the suction grippers rotate outwards. With the upper pull that is connected to the suction gripper or the housing of the suction gripper by an articulated joint, the curvature of the cantilever arms can increase more at their free ends than in their other sections.

According to another possible embodiment of the inventive device the upper pull and the lower pull of each cantilever arm are interconnected between the bridge and the free end by at least one connecting bar. The connective joint between the at least one connecting bar and the lower pull can be formed largely bending resistant, bendable or articulated. Also the connective joint between the connecting bar and the upper pull can be formed largely bending resistant, bendable or articulated. Optionally two, three or more connecting bars can be arranged between the upper pull and the lower pull of each cantilever arm. Optionally a respective spring element can be assigned to the articulated connective joints to provide an automatic return to the starting position.

The connecting bars are constructed either extensive, columnar, scaffold-like or cross-piece like. They ensure that the pulling forces acting on the upper pull are transferred largely uniformly to the lower pull. The pulling forces are required for the lifting and simultaneous swiveling of the free ends of the cantilever arms and the attached suction grippers. The connecting bars transfer the tensile forces largely uniformly to the lower pull. In this case the lower pull exerts a supportive and reinforcing effect and prevents that the free ends of the cantilever arm bent outwardly too much without being simultaneously lifted to the desired extent. The distribution of forces over the upper pull onto the lower pull ultimately causes the desired deformation of the cantilever arm along its entire length. The local deformation behavior as well as the overall deformation behavior of the cantilever arms can be influenced and modified through the above-mentioned optional articulated joints that can be formed relatively flexible instead of a rigid linkage. It may possibly be useful to increasingly deform the cantilever arms in the direction of their free ends, while the sections close to the suspension are formed stiffer.

The mentioned connecting bars are not mandatory but optional. The elastic properties of the cantilever arms can be influenced in a suitable way by these connecting bars. Different embodiments are possible, for instance embodiments without any connecting bars between the upper pull and the lower pull or embodiments with just one connecting bar between the upper pull and the lower pull or embodiments with virtually any number of connecting bars positioned variably between the upper pull and the lower pull or embodiments with cross connected connecting bars between the upper pull and the lower pull.

It should be emphasized at this point that the upper pull and the lower pull must not be formed as flat components with struts arranged intermediately. Thus, an alternative embodiment can also provide that at least sections of the cantilever arms are formed as an integrated voluminous component, especially a composite component with defined elastic properties. If the term voluminous component is used in the present context, it can be used to describe a foamed component with or without apertures or openings, a honeycomb structure component or the like. The person skilled in the art knows other alternative variations that can be used to achieve the desired material properties and elastic properties and to ultimately achieve the desired deformation behavior of the cantilever arms, which is similar to the aforementioned "Fin-Ray" principle. Usually the term "Fin-Ray" effect is used to describe a phenomenon observed in fish. When the tail fins of certain fish are subjected to lateral pressure, they do not yield in the direction of the applied pressure. Instead they bulge out in the opposite direction; especially they bulge out in the direction from where the pressure is coming. In this context, the "Fin Ray" principle is modified in the following way: The fin-like motion of the suction grippers attached to the cantilever arms is not achieved by a pressure applied onto the top of the upper pull of the cantilever arms. Instead, the fin-like motion is achieved by the puling force that acts on the upper pull in a horizontal direction. For the function and the implementation of the desired movement and deformation behavior it is fundamentally irrelevant whether a component is used that consist of the clearly recognizable elements upper pull, lower pull and cross struts or whether a component is used whereby the single elements are combined in an integrated design.

Even when using such composite components two alternative embodiments of single piece components are possible. The first variation features a continuous lower pull and thereby a continuous shaping. The second variation shows a two-piece design with separate cantilever arms that are arranged symmetrically but require a central bearing at the bridge. The central bearing is usually located close to the lower pull or at the bottom side of the cantilever arms. The single-piece variation with a continuous lower pull is designed as an integrated component that comprises both cantilever arms arranged as a symmetric pair. The lower pull can either be connected centrally to the already described bridge or it can be supported on the bridge in a flying mount if required. In the single-piece variation at least the single-piece lower pull can act as a laminated spring, whereby the lower pull or the laminated spring seeks to return to its original extended position as soon as it is no longer attacked by deformation forces or pulling forces. It may also be advantageous in this variation if the upper pull, acting as a laminated spring, is additionally reinforced. The construction of the reinforced upper pull can resemble a multilayer laminated spring. Such an additional reinforcement can effectively prevent a failure of the component after extended operations, for example it can prevent a stress fracture.

The pulling means provide a horizontal or slanted upward pulling movement on the upper pull. The pulling means can be formed by nearly horizontal or inclined flat acting linear drives, which are preferably supported on the bridge. Such linear drives can be constructed for example as pneumatic cylinders or hydraulic cylinders, as electric motors or pulling drives. Preferably known components are used as suction grippers. The suction grippers are connected to a central vacuum supply via hose pipes. The suction properties of the suction grippers can be controlled individually or jointly. The bending movement of the lower pull can be adjusted by adjustable stopping elements, distance elements, spacers or the like, especially by spacers formed by compressed air cylinders. It must not be emphasized separately at this point that a synchronous deflection and control of the actuators is possible when using two single actuators to jointly control a pair of cantilever arms, provided a uniform deformation of both cantilever arms is desired. However asymmetric lifting movements and asymmetric deformation movements are equally possible. These asymmetric movements can be triggered by a controlled offset of the lifting movement of the actuators. In this case, any almost non-uniform deformation and thus any almost non-uniform lifting movement of the device according to the invention can be achieved by a selective activation of several actuators.

The device according to the invention typically shows a hanging arrangement and can for instance be moved by a horizontally and/or vertically adjustable extension arm. The complete suction gripper head with all its control components and movement components can be fixed to a central column, which is suspended from the end of the extension arm. If necessary the column can additionally be formed rotatable. Depending on the purpose this might not be required. The extension arm mentioned above can itself be suspended from a machine frame, a rotary column or the like, that may have a floor anchorage.

The invention furthermore relates to a method for receiving, holding and/or handling two-dimensional objects with at least two controllable suction grippers. The suction grippers are each mounted to free ends of cantilever arms. The cantilever arms are elastic at least in some sections or they are movable by swiveling movements. The cantilever arms are supported on a bridge and/or mounted on the bridge. The cantilever arms each comprise at least one lower pull and one upper pull, which meet at the free end of the cantilever arm. At the meeting point the upper pull and the lower pull are connected in a substantially rigid connection and arranged in the area of the bridge at a distance from each other. The lower pull is connected to the bridge at a defined position. The upper pull can be moved approximately parallel to the longitudinal extension direction of the cantilever arm by a actuating means or pulling means with at least one horizontal direction component. Through the pulling forced exerted on the upper pulls of the cantilever arms the suction grippers, which are virtually vertically aligned in a first position, describe an arcuate trajectory. Simultaneously the suction grippers are inclined at an angle. According to the invention the cantilever arms are each deformed by the pulling movement exerted on the upper pulls. Thereby the lower leg bends upward, meanwhile the upper leg shortens or moves towards the bridge. Thereby the free ends of the cantilever arms together with the attached suction grippers are bending upwards. Under the action of these actuating or pulling forces the entire cantilever arms together with the upper pulls and the lower pulls are elastically deformed. This is also known as "Fin-Ray"-principle.

The present invention overcomes some of the drawbacks that have been identified with the previously known lifting devices. One of the requirements is to produce production plants more cost-effectively. The device according to the invention and the appropriate method do not require stores for intermediate layers. They furthermore do not require a pre-separation of the stacked plates or other suitable retaining systems. Thereby the costs for such production plants can be reduced. The feeding of the production plant with stacked two-dimensional objects can be automated without any extra effort or increases in costs. The stacked two-dimensional objects are used as intermediate layers between layers of packs or as intermediate layers on pallets with several layers of beverage containers. In addition, the required placement accuracy of the stack is not very high, because the receiving and handling device is relatively tolerant regarding the exact positioning of the objects to be lifted.

In contrast to the aforementioned horizontal or diagonal pulling forces acting on the upper cantilever arm, the cantilever arms can optionally also be deformed by thrusting forces. Alternatively, the deformation of a pair of cantilever arms can also be caused by several pulling components, acting in a vertically upward direction. The upper pulls may be connected by an articulated joint and can be pulled upwards via a suitable pulling means. Thereby the above-mentioned "Fin-Ray" deformation can be achieved in a similar manner.

The cantilever arms can be made from various materials, optionally a combination of different materials can be used. The different materials can be connected by gluing, screwing, welding, plug-in connection systems etc. The connecting bars mentioned above may be arranged vertically or diagonally, whereby the rigid or articulated connective joints can be made separable or inseparable. The connecting bars can be formed as flat parts or as thin, preferably unfoldable struts made from any suitable material, for example made from injection-molded plastic. In an articulated joint or a similar connection a supporting spring can also be installed or integrated. The spring provides a sufficient restoring force which is required to return the cantilever arm from a deflected position back into the relaxed resting position.

Furthermore, the inventive handling device can be used in combination with other gripping tasks, for example with mechanical acting pallet grippings, with top frame grippers or the like. The additional grippers are preferentially arranged on the same frame, thereby creating an integrated design.

Another embodiment of the movable functional components of the inventive device for receiving, holding and/or handling two-dimensional objects can provide that the controllable suction grippers are individually or pair wise attached to the free ends of pivotally movable and deformable cantilever arms. The cantilever arms are for example mounted and connected to a bridge in a symmetrical arrangement or the cantilever arms are only supported on the bridge and/or the cantilever arms are supported on the bridge in a flying mount. The two-dimensional objects handled by the device according to the invention can be cardboard sheets, plastic sheets or metal sheets or twin-wall sheets made from plastics or cardboard, which are for instance used as intermediate layers between several stacked layers of beverage containers arranged on pallets etc. In such an embodiment the cantilever arms do not need to be formed elastically deformable. Instead the cantilever arms can be made from several stiff segments that are interconnected by articulated joints. The interaction of the interconnected plates allows a similar movement of the cantilever arms as in the embodiments described previously. In this further embodiment of the invention the cantilever arms can exert defined and superimposed lifting movements and pivoting movements by articulated movements of the plate segments.

The symmetrically and wing-like arranged cantilever arms each comprise a horizontally disposed, two-dimensional or plate-like lower pull. The cantilever arms furthermore comprise an upper pull that is inclined in an acute angle to the horizontal. The upper pull is also formed two-dimensional or plate-like. The lower pull and the upper pull meet at the free end of the cantilever arm and are preferably connected at this meeting point by an articulated joint. All existing articulated joints between the pivotally interconnected panel segments only allow swivel movements around axes which are parallel to each other. Usually the axes are oriented horizontally and transverse to the longitudinal extension direction of the lower pull. The entire lower pull extends over the two articulated connected, moveable, symmetrically arranged cantilever arms and is formed by a plurality of interconnected plate segments. Each of the two upper pulls is also formed by several panel segments interconnected by articulated joints. If required a central plate segment of the lower pull can be slightly shorter or longer than the two plate segments neighboring this central plate segment on both sides. Moreover, this central panel segment can be anchored to the bridge of the device, screwed to the bridge or just supported on the bridge in a so called flying mount. The two plate segments immediately adjoining the central plate segment of the lower pull on both sides are each articulated connected to the inner plate segments of the upper pulls by first coupling rods. The subsequently adjoining plate segments of the lower pull are articulated connected to other plate segments of the upper pulls by second coupling rods. Meanwhile the respective outermost plate segments of the upper pulls and respective outermost plate segments of the lower pull can be connected at their respective free ends by articulated connections. Alternatively only a rigid connection is possible between these outermost plate segments at the ends of the upper pulls and the lower pull. The two inner first coupling rods are each longer than the two outer second coupling rods. Thereby the overall wing-like shape of the arrangement according to one of the previously described embodiments is achieved. The location and functionality of the coupling rods largely corresponds to the location and functionality of the connecting bars of the previously described embodiments. The main difference is that the coupling rods are not connected rigidly but mounted on pivot pins. Thereby the coupling rods are each articulated connected to the corresponding plate segments of the upper pull or lower pull.

Optionally the coupling rods may be formed to simultaneously act as movement stops. This can be achieved by an appropriate shaping or profiling. The movement stops ensure that mutually facing surfaces of the plate segments of the upper pulls and the lower pulls meet with a defined maximum displacement. A deflection movement beyond the defined maximum displacement movement is not possible. A central plate segment of the lower pull of such a multi-piece gripping module formed by pivotally interconnected plate segments can be provided with an additional bridge segment. This bridge segment provides an articulated connection or support to a rigid bridge according to one of the previously described embodiments.

Some or each of the articulated joints between the plate segments may optionally include a spring element, for example a spring band partially enclosing the plate segments or something alike. Such spring bands couple neighboring plate segments. Therefore these neighboring plate segments are not fully and freely movable about the respective connecting axis. Instead the neighboring plate segments return into their initial or original position after each deflection. In this initial position the lower pull is stretched nearly straight and without any curvature. By using spring bands of different strength the spring forces and the restoring forces can be varied. Alternatively, the spring forces acting between plate segments interconnected by articulated joints can also be achieved by the use of different spring elements. For instance laminated spring elements can be integrated into the articulated joints, elastic pins can be positioned between the plate segments or other suitable means can be used.

Basically, even more embodiments are conceivable, which are not further explained here. Thereby the upper pulls can be formed by ropes, straps, link chains or something similar that are interconnected to the lower pull or lower pulls by suitable coupling elements either by articulated, elastical or at least partially rigid connections. If in the context of the present invention the definition elastic or articulated upper pulls is used, it comprises all variations with flexibly movable upper pulls that are for instance formed by girths, ropes etc.

The device according to the invention can optionally comprise a plurality of gripping modules, which can be controlled and moved independently. Thus, the device can comprise two gripping modules that are suspended from a common carrier, whereby the distance between the two gripping modules is adjustable and/or whereby the two gripping modules are controllable and movable independently of each other. Optionally the two gripping modules can also be controlled together. This is particularly useful for lifting and handling large plate-like components. The two gripping modules can also be moved independently of each other. This can be useful for example for the separate handling of correspondingly smaller plate-like components. Especially smaller plate-like components can be handled just by one gripping module, whereby a gripping module comprises up to four or more movable suction grippers. When handling smaller components, for instance so called intermediate layers for half-pallets; it is also possible to activate just one of the gripping modules. The other gripping module remains inactive as long as it is not needed.

Moreover, in such an embodiment according to the invention the distance between the two gripping modules may be adjusted. This can be achieved by the suspension of the gripping modules on slide guides, which are positioned on a common frame. For each gripping module the slide guides include a pair of horizontal axes. The mounting sections or the upper suspensions means of the gripping modules including their drive components and control components are mounted on the pair of horizontal axes. The entire arrangement is especially mounted slidably and can be moved along the axes in a horizontal direction. Each gripping module together with its whole suspension means and driving means can especially be moved in a horizontal direction about a certain distance along the frame and fixed in this new position. In this way the two gripping modules can be controlled independently. Furthermore the gripping modules can be adjusted to different sizes of intermediate layers for half-pallets or to different sizes of two-dimensional objects or the like. The above-mentioned adjustment or distance variation of the gripping modules can either be done manually or mechanically, for instance with an electric drive, a pneumatic drive or any other fluid drive.

Another option may provide that the inventive device is equipped with a pallet gripping system. The pallet gripping system is arranged on the common frame together with the at least one controllable gripping module. The pallet gripping system can be controlled independently of the gripping module and/or the pallet gripping system can be swivel mounted. This pallet gripping system can for example include suitable gripping arms attached to the frame of the device. The gripping arms enable the pallet gripping system to act as an intermediate layer gripper and/or pallet gripper. The at least two oppositely movable and/or pivotable gripping arms are preferably controllable and movable independently of the gripping modules for the intermediate layers or two-dimensional objects. An advantageous variation of such a pallet gripping system can for instance be combined with the distance adjustment of the pair wise arranged gripping modules, whereby the distance between the two gripping modules of a pair can be adjusted. The combination of the pallet gripping system and the pair of gripping modules can be achieved by an elongation of the already existing slide-guide-adjustment system that comprises appropriate holding means at each end. These holding means can for example be formed by metal clips, etc.

The holding means can comprise hooks, differently shaped retaining lugs or the like. The hooks etc. each point inwardly, especially facing each other and are arranged at the bottom side of the holding means. The holding means serve for engaging, receiving and handling the pallet.

BRIEF DESCRIPTION OF THE DRAWINGS

In the following passages, the attached figures further illustrate exemplary embodiments of the invention and their advantages. The size ratios of the individual elements in the figures do not necessarily reflect the real size ratios. It is to be understood that in some instances various aspects of the invention may be shown exaggerated or enlarged to facilitate an understanding of the invention.

DETAILED DESCRIPTION

The same or equivalent elements of the invention are designated by identical reference numbers in FIGS. 1 to 18. Furthermore and for the sake of clarity, only the reference numbers relevant for describing the respective figure are provided. It should be understood that the embodiments described are only examples and they are not intended to limit the scope of the disclosure.

Figure 1:
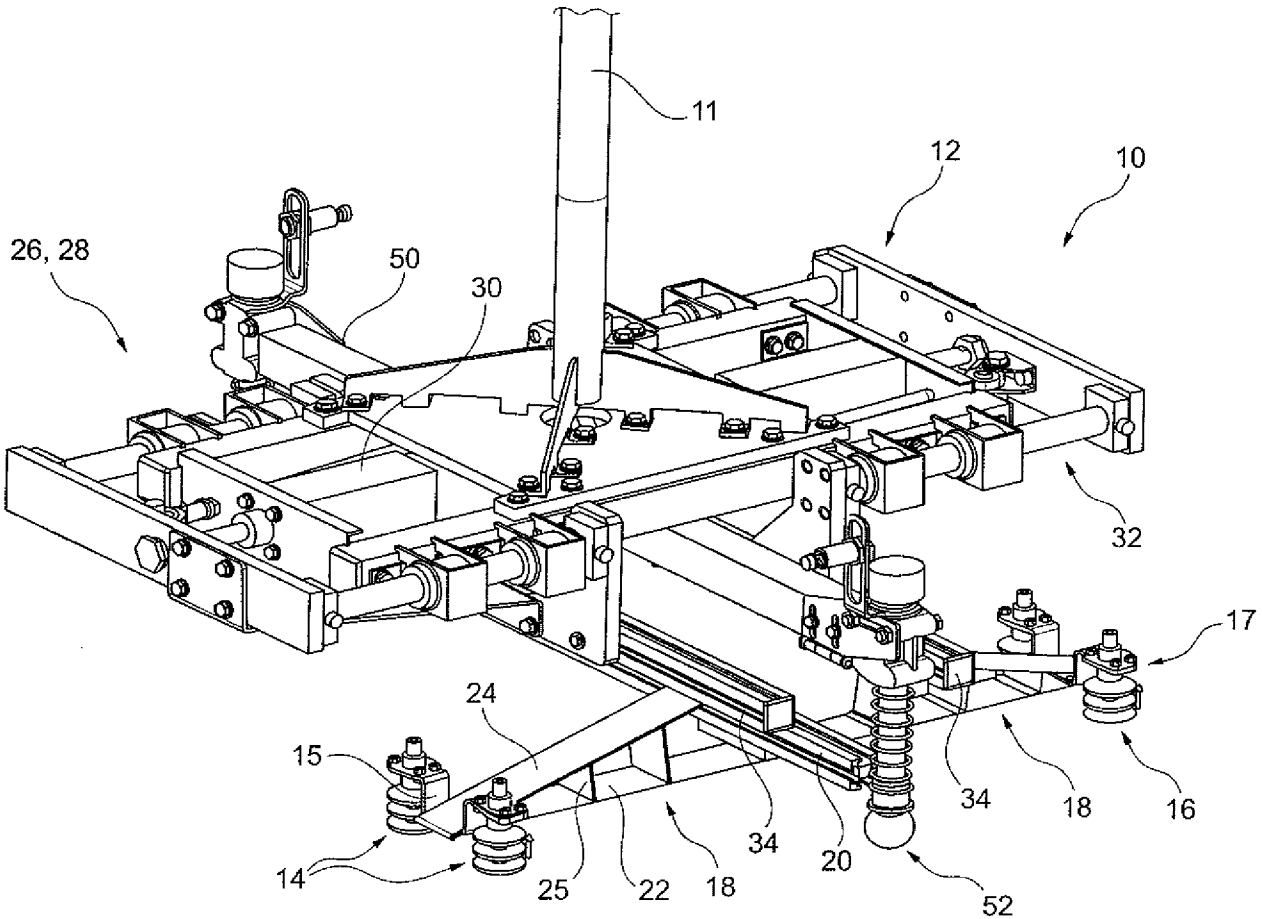
FIG. 1 shows a schematic perspective view of one embodiment of a receiving, holding and/or handling device for two-dimensional objects according to the invention.

The schematic perspective view of FIG. 1 shows an embodiment of a device 10 according to the invention for receiving, holding and/or handling two-dimensional objects like cardboard sheets, plastic sheets or metal sheets or twin-wall sheets made of hollow plastic or cardboard. The two-dimensional objects are for instance used as intermediate layers between several layers of beverage containers stacked on a pallet. The device comprises a frame 12 suspending from a central column 11 or suspending from a machine extension arm or something similar. The suspended frame 12 can be attached to a machine extension arm of a handling device, whereby the handling device is height adjustable and spatially mobile. The device 10 includes four controllable suction grippers 14 arranged at the bottom of the frame 12. The suction grippers 14 can occupy a so called resting position, whereby the suction grippers 14 are aligned perpendicular and are thus ready for receiving horizontally stacked sheets or other two-dimensional objects. The four suction grippers 14 are attached pair wise at the free ends 16 of movable and elastically deformable cantilever arms 18. The cantilever arms 18 are mounted and fixed in a symmetrical arrangement on a bridge 20 (see FIGS. 2 and 3) or the cantilever arms 18 are just supported on the bridge 20 and/or the cantilever arms 18 are arranged on the bridge 20 in a flying mount (see FIGS. 4 and 5). The bridge 20 which acts as bearing, fixation means and/or support means is rigidly connected to the frame 12 of the device 10.

The extension arms 18 are formed elastically in such a way, that they cannot be moved in any arbitrary articulated way. Instead defined and superimposed lifting movements and arbitrary pivoting movements can be achieved by elastic deformations of the cantilever arms 18. The symmetrically arranged and wing-like cantilever arms 18 each comprise a horizontally arranged planar or sheet-like lower pull 22, a "pull" being a support movable by a force. The cantilever arms 18 furthermore comprise an upper pull 24 that is inclined from the horizontal plane at an acute angle. The upper pull 24 is also formed planar or sheet-like. The lower pull 22 and the upper pull 24 meet and are interconnected at the free end 16 of the cantilever arm 18. According to the embodiment shown in FIG. 1 the lower pull 22 and the upper pull 24 are connected rigidly, especially the connection is not articulated at the meeting point. An alternative embodiment (not shown here) can provide an articulated connection between the upper pulls and the lower pulls 24, 22 at the free ends 16 of the cantilever arms 18.

Furthermore pairs of respective suction grippers 14 are arranged side by side at the free ends 16. The anchorage of the suction grippers 14 is not articulated but rigid or only slightly elastic to the extent of the elastic properties of the upper pull 24 and the lower pull 22. According to FIG. 1 the suction grippers 14 may be fixed to the lower pull 22 in the section of the free end 16 by a multi-angled mounting plate 15. Thereby the optionally rigid or slightly elastic or articulated connection to the upper pull 24 is not influenced.

Furthermore, the lower pull 22 and the upper pull 24 of each cantilever arm 18 are connected via a plurality of vertical, plane or sheet-like connecting bars 25. Like the lower pull 22 and the upper pull 24 the connecting bars 25 are preferably elastic to a certain extent, but at the same time resistant to folding and relatively rigid. According to a first embodiment the connective joints between the connecting bars 25 and the lower pull 22 or the upper pull 24 are not articulated but slightly elastic depending on the material properties of the firmly joined sections. Elastic, bendable or articulated connections are also possible between the upper pull 24 and the connecting bars 25 and/or between the lower pull 22 and the connecting bars 25. These mentioned connective joints and crossing points can be combined in any way, thereby it is possible to define the elastic properties and the exact deformation behavior of the cantilever arms 18 within broad limits.

According to the embodiment shown in FIG. 1 the upper pull 24 and the lower pull 22 are mounted at a certain distance from each other in the area of the bridge 20. Thereby the lower pull 22 is fixed to the bridge 20 at a defined position. Optionally a single continuous lower pull 22 according to the embodiments shown in FIGS. 4 and 5 can be used. The single continuous lower pull 22 is either fixed to the bottom side of the bridge 20 or the single continuous lower pull 22 is just supported on the bottom side of the bridge 20 and moreover connected by a so called flying mount.

In the present context the term gripping module 17 is used for a module comprising a pair of symmetrically arranged cantilever arms 18, whereby each cantilever arm 18 consists of a lower pull 22, an upper pull 24 and at least one connecting bar 25. The schematic views of FIGS. 2 to 5 illustrate the functionality of such a gripping module 17. A first variation of a gripping module 17 with a continuous lower pull 22 supported on the bridge 20 and with two symmetrical upper pulls 24 supported on cross struts 34 is furthermore shown in the perspective views of FIG. 1 and FIG. 8. The schematic representations of FIGS. 9 to 15 show different views of an alternative embodiment of a gripping module 17.

Figure 8:
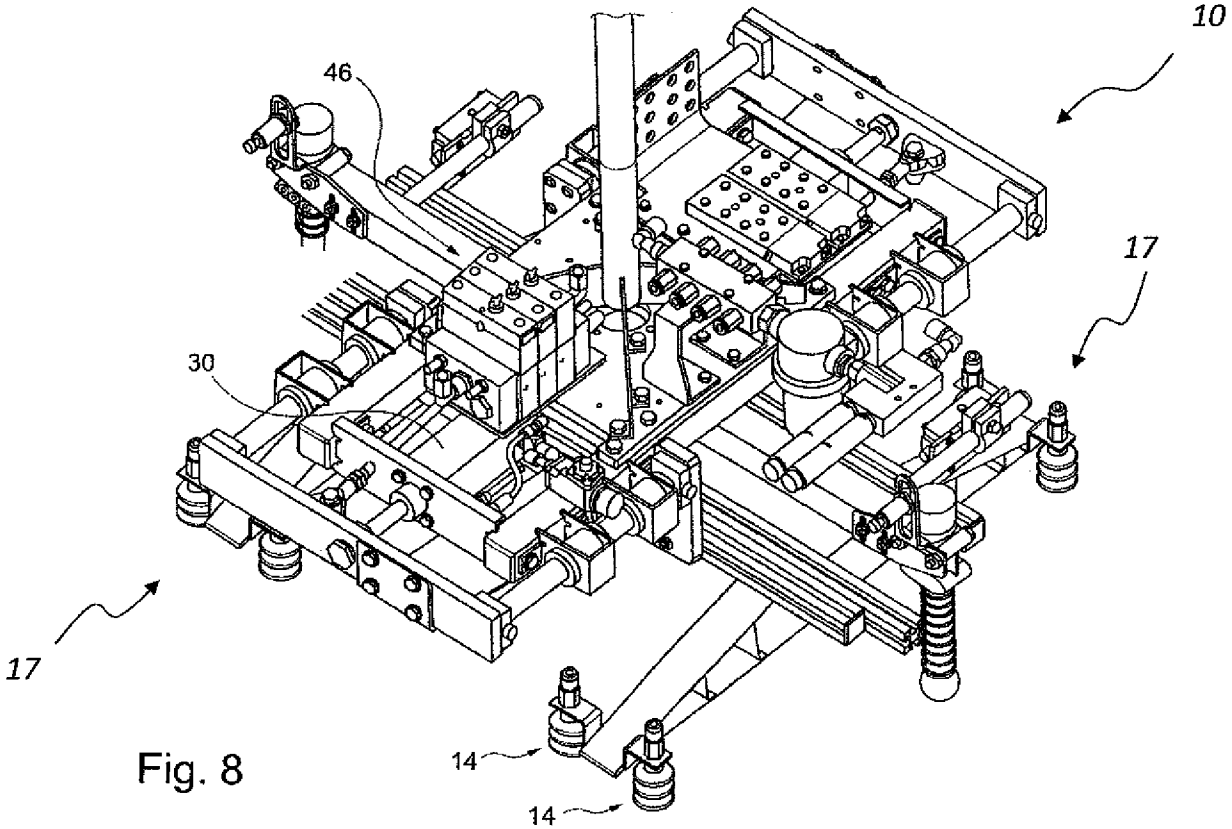
FIG. 8 shows another schematic perspective view of the receiving, holding and/or handling device for two-dimensional objects.

A puller or pulling means 26 or an actuator or actuating means 28 is assigned to each of the upper pulls of the respective cantilever arms 18. The pulling means 26 or actuating means 28 are used for generating a horizontally directed pulling force, which is approximately parallel to the longitudinal extension direction of the respective cantilever arm 18. Usually the two actuating means 28 synchronously work against one another. In the illustrated embodiment, the actuating means 28 each comprise a linear drive 30, for example a hydraulic cylinder or a pneumatic cylinder or the like. The two linear drives 30 are horizontally anchored to the frame 12. The two linear drives 30 together with rod drive 32 each induce horizontally directed actuating movements onto the cross struts 34. One, two or more parallel anchorages of upper pulls 24 of one or more cantilever arms 18 can be attached to the cross struts 34. The view according to FIG. 1 just shows one symmetrical pair of cantilever arms 18, each cantilever arm 18 carrying a pair of suction grippers 14. FIG. 8 shows a preferred embodiment with two pairs of cantilever arms 18, each of which can be synchronously moved and adjusted by means of the horizontally movable cross struts 34.

FIG. 1 furthermore shows tactile elements 52 that are anchored to a further cross strut 50. The tactile elements 52 act as depth adjustment means for the device 10. An upwardly movable plunger has a tactile ball at its bottom side. The plunger is acting vertically against the restoring force and is furthermore acting against the downward gravitational force. The plunger can for instance be coupled to a displacement sensor or the like. The displacement sensor supplies the control of the device 10 with a displacement restriction signal. This allows a reliable vertical positioning of the device 10 over stacks of two-dimensional objects which decrease in height during processing. The tactile elements 52 can also purely act as mechanical stoppers that prevent a hard knock down of the bridge 20 or the lower pulls 22 of the cantilever arms 18 on the stack from which the respective objects are removed.

Figure 2:
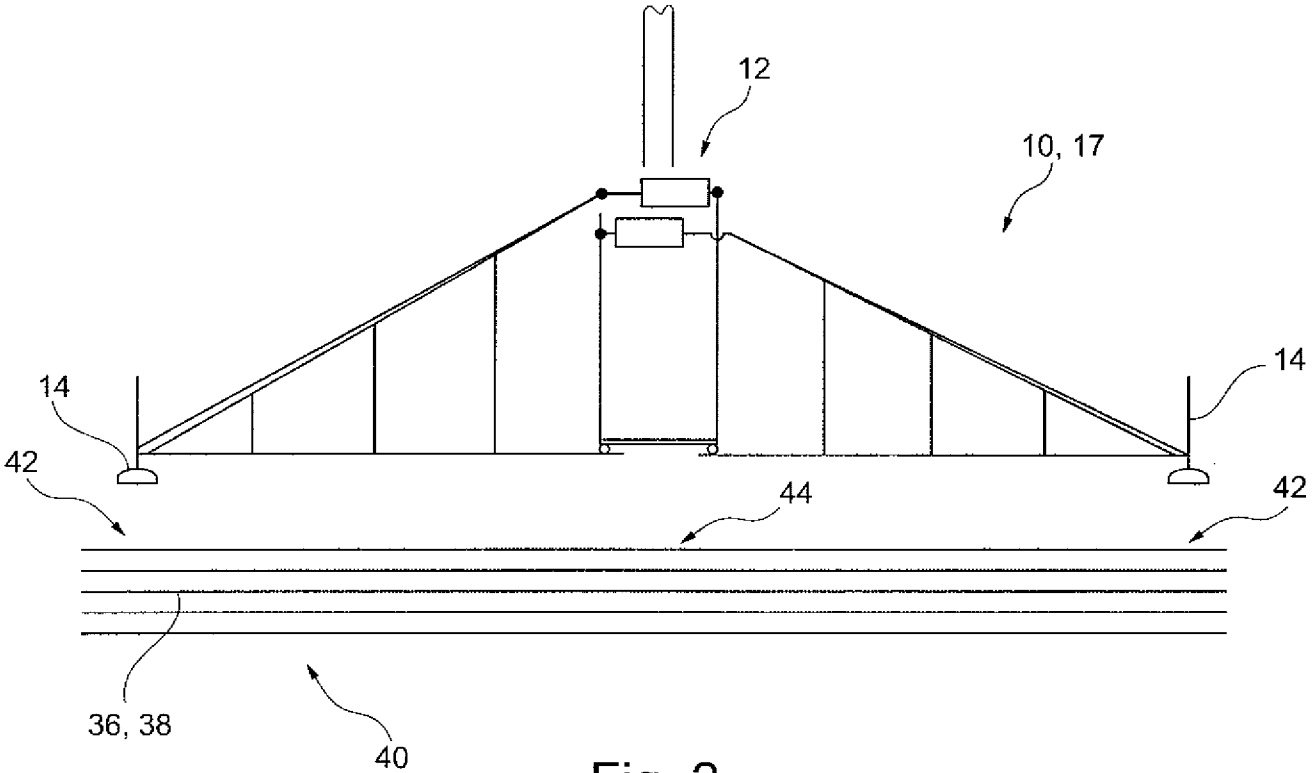
FIG. 2 shows a schematic side view of a first variation of the device according to the invention in a first operating position.
Figure 3:
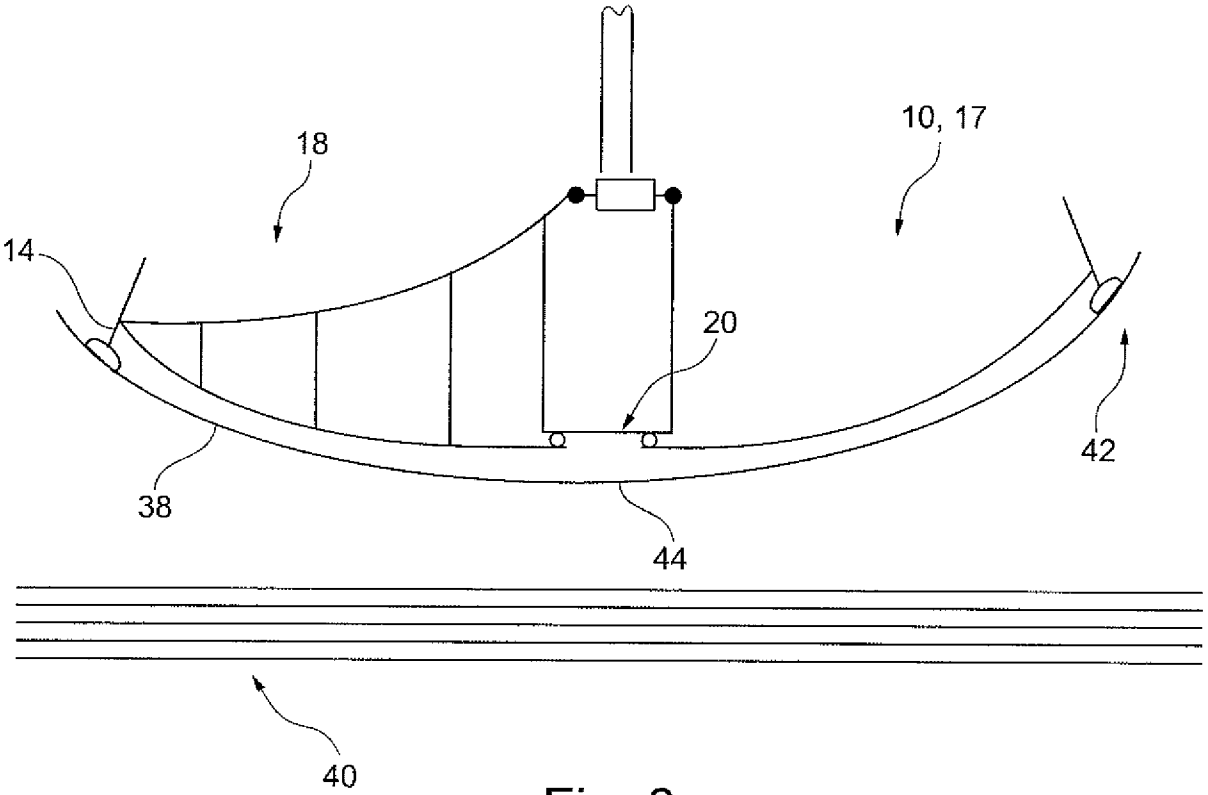
FIG. 3 shows a schematic side view of a device according to FIG. 2 in a second activated operating position.

The schematic diagrams of FIGS. 2 and 3 illustrate the working principle of a first embodiment of the device 10 according to the invention. Hereby a controlled movement of the two or more suction grippers 14 can be achieved, which is also known by the term "Fin-Ray"-principle (similar to a stingray wing motion). The trajectories of the suction grippers 14 allow the lifting of plates 36, sheets or other two-dimensional objects 38 from stacks 40. Initially the peripheral areas 42 of the plates 36 or two-dimensional objects 38 are lifted, whereby the central area 44 of the plate-like object 38 is detached from the underlying object 38. The detachment of the peripheral areas 42 prevents the undesirable sticking effects. Subsequently the two-dimensional object 38 can be lifted, whereby the suction grippers 14 simultaneously swing back into their vertical initial position. Thereby the underlying object is not pulled along, not moved sideways or not influenced in any other undesirable way.

The rigid connection between upper pull 24, lower pull 22 and suction gripper 14 at the free end 16 allows the desired and preferred trajectory of the suction gripper 14 according to FIG. 3. In a side view the trajectory resembles the dynamical upwards and downwards movement of wings. Thereby the cantilever arms 18 are deformed over their entire length as shown in FIG. 3. To achieve this trajectory it may be necessary that the connective joints between the upper pull 24 and the lower pull 22 as well as the connective joints between the cantilever arm 18 and the suction grippers 14 are not articulated but rigid or only slightly elastic depending on the extent of the material elasticities. These kinds of connections can also be useful for achieving certain desired deformation properties. The suction grippers 14 are approximately vertically aligned in a first position (see FIG. 2). With appropriate dimensioning of the elasticities of the individual elements of the cantilever arms 18, the suction grippers 14 can describe an arcuate trajectory. The arcuate trajectory is triggered by the actuation of the pulling means 26 acting on the upper pulls 24 of the cantilever arms 18. At the same time the suction grippers 14 are inclined at an angle, so that the central area 44 of the received two-dimensional object 38 is drawn upwardly against the bottom side of the bridge 20. Meanwhile the peripheral areas 42 are lifted from the stack 40 by the rising and simultaneously rotating suction grippers 14, whereby the bottom sides of the suction grippers 14 rotate outwardly. To specifically influence the movement patterns and to achieve the desired deformation behavior of the cantilever arms 18 for each particular case or respective dimension, whereby the cantilever arms 18 are deformed similar to FIG. 3 over their entire length uniformly or in a progressive manner, it has proven to be useful that some or all of the connective joints between the upper pull 24 and the lower pull 22 as well as between the cantilever arm 18 and the suction grippers 14 are at least partially articulated.

The suction grippers 14 are approximately vertically aligned in a first position. With appropriate dimensioning of the elasticities of the individual elements of the cantilever arms 18 and of the frictional forces of the individual articulated joints of the suction grippers 14 (see FIG. 2), the suction grippers 14 can describe an arcuate trajectory. This trajectory is achieved when the pulling means 26 acting on the upper pulls 24 of the cantilever arms 18 are operated. At the same time the suction grippers are inclined at an angle, whereby the central area 44 of the received two-dimensional object 38 is drawn upwards to the bottom side of the bridge 20. During this the peripheral areas 42 are lifted from the stack 40 by the rising suction grippers, whereby the bottom sides of the suction grippers 14 simultaneously rotate outward.

Figure 4:
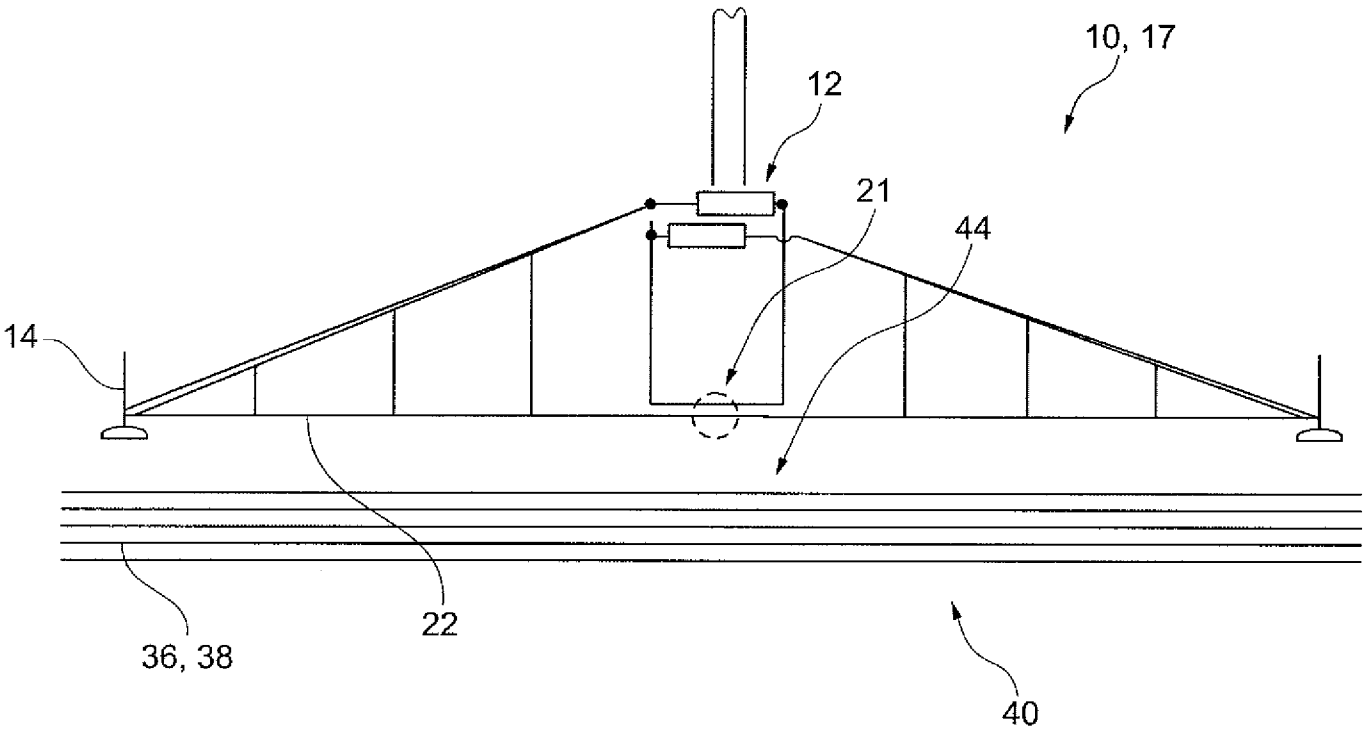
FIG. 4 shows a schematic side view of a second variation of the device according to the invention in a first operating position.
Figure 5:
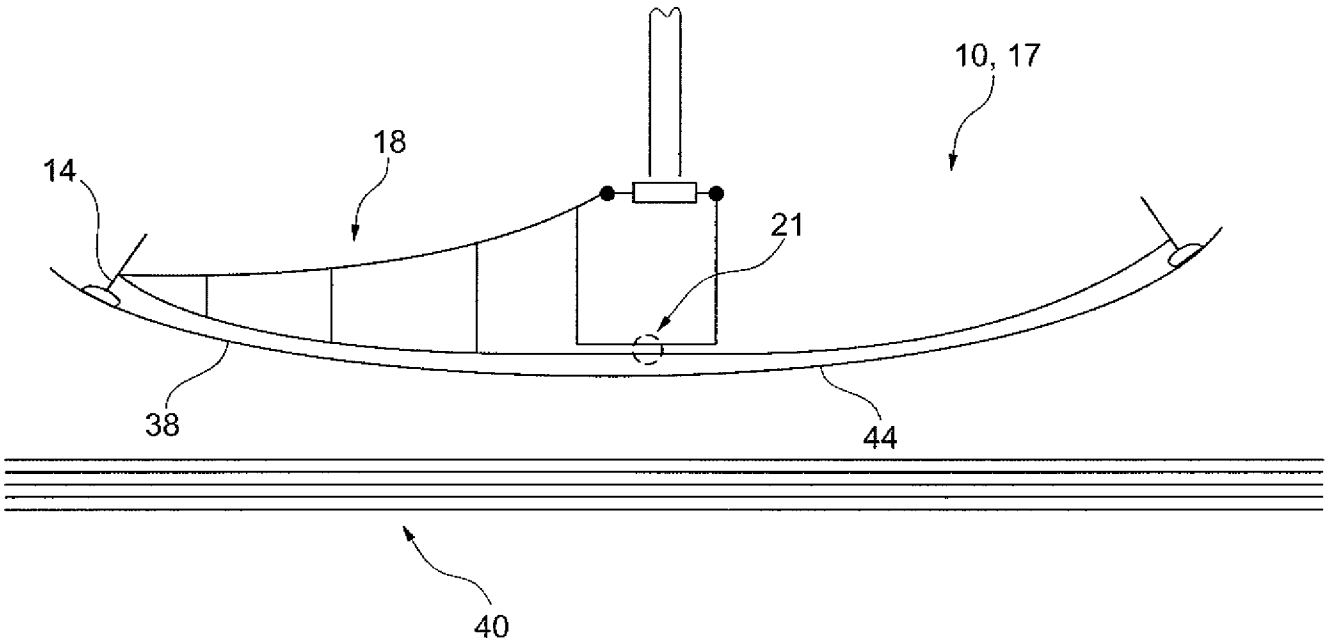
FIG. 5 shows a schematic side view of a device according to FIG. 4 in a second activated operating position.

The second embodiment shown in FIGS. 4 and 5 differs from the first embodiment essentially by the design of the lower pull 22. Hereby the lower pull 22 is not made of two pieces. Instead a single continuous lower pull 22 extends over both cantilever arms 18. The single continuous lower pull 22 is mounted on a central bearing 21, whereby it is either anchored tightly to the bridge 20 or just supported on the bridge 20 in a so called flying mount. The other functionalities of the device 10 and the trajectories of the cantilever arms 18 with the attached suction grippers 14 do not differ from the embodiment shown in FIGS. 2 and 3.

Figure 6:
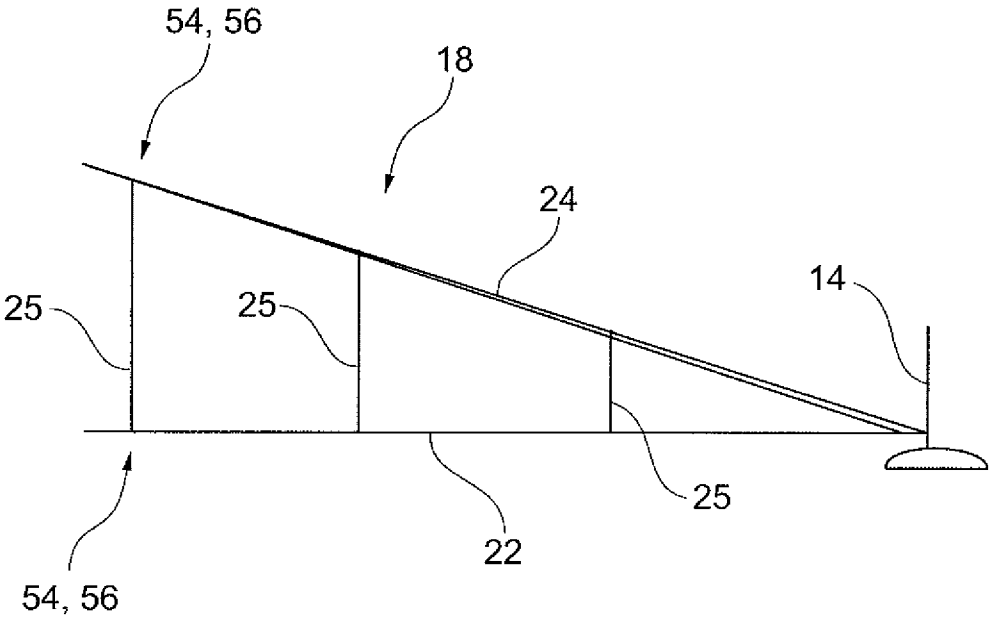
FIG. 6 shows a detailed view of one embodiment of a deformable cantilever arm of the device with an attached suction gripper.

As illustrated by the embodiments shown in FIGS. 1 to 5 and the detailed representation of FIG. 6, the upper pull 24 and the lower pull 22 of each cantilever arm 18 are interconnected between the bridge 20 and the free end 16 by three vertical connecting bars 25 or cross struts. The connective joints between the connecting bars 25 and the upper pull 24 and between the connecting bars 25 and the lower pull 22 may optionally be formed as rigid or articulated connections. The connecting bars 25 ensure that the pulling forces acting on the upper pull 24, which are leading to the simultaneous lifting and tilting of the free ends of the cantilever arms 18 and the attached suction grippers 14, are transmitted substantially uniformly onto the lower pull 22. In this case the lower pull 22 exercises a supporting and reinforcing effect. The lower pull 22 prevents the free ends 16 from too much outward bending when they are not simultaneously lifted to the desired extent. The distribution of forces across the upper pull 24 and the lower pull 22 causes the deformation of the cantilever arm 18 along its entire length as shown in FIGS. 3 and 5.

The detailed representation of FIG. 6 shows an example of three vertically-arranged connecting bars 25 between a relaxed, horizontally arranged lower pull and an upper pull 24, which is oriented at an acute angle to the lower pull 22. The upper pull 24 transfers the pulling forces onto the cantilever arm 18. The connecting bars 25 may be connected to the upper pull 24 or the lower pull 22 either by fixed or rigid connections 54 or by articulated connections 56. Which of the connections 54 and/or 56 is used depends on the desired deformation behavior of the respective cantilever arm 18. This is usefully determined by a test series.

Figure 7:
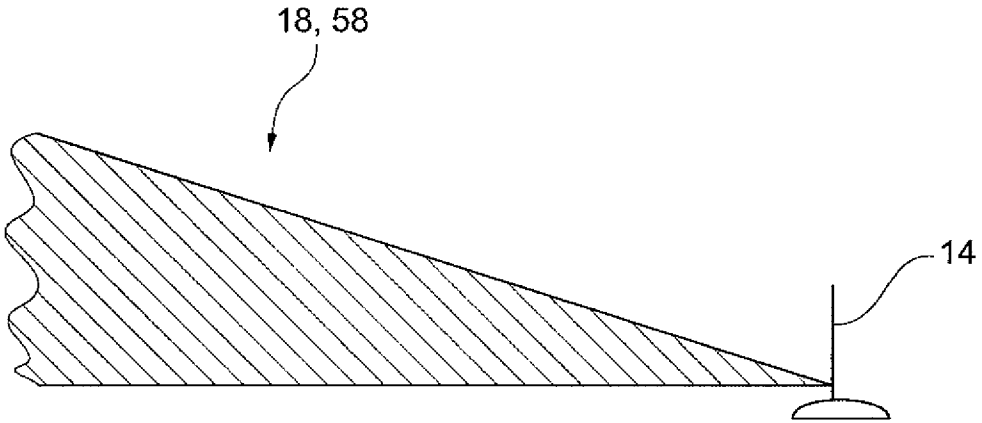
FIG. 7 shows a detailed view of another variation of the cantilever arm.

According to FIG. 7 the cantilever arm 18 can be formed as a composite component 58, for example, as a foamed plastic component or fiber composite component or the like. The elastic properties can be defined by optional breakthroughs (not shown here), variable fiber density of the reinforcing fibers and/or variable orientation of the fibers in the component 58. The elastic properties can be fine tuned by using these different variations either individually or in combination. Thereby the elastic properties of the cantilever arms 18 can be optimized according to the required function.

The schematic view of FIG. 8 shows the already described components. Furthermore a control block 46 is shown, which connects the actuators like suction grippers 14 and linear drives 30 via hose pipes and allows the controllability of the actuators. As suction grippers 14, linear drives 30, control valves and adjustment valves of the control block 46 known components can be used, which comprise a central vacuum supply.

Figure 9:
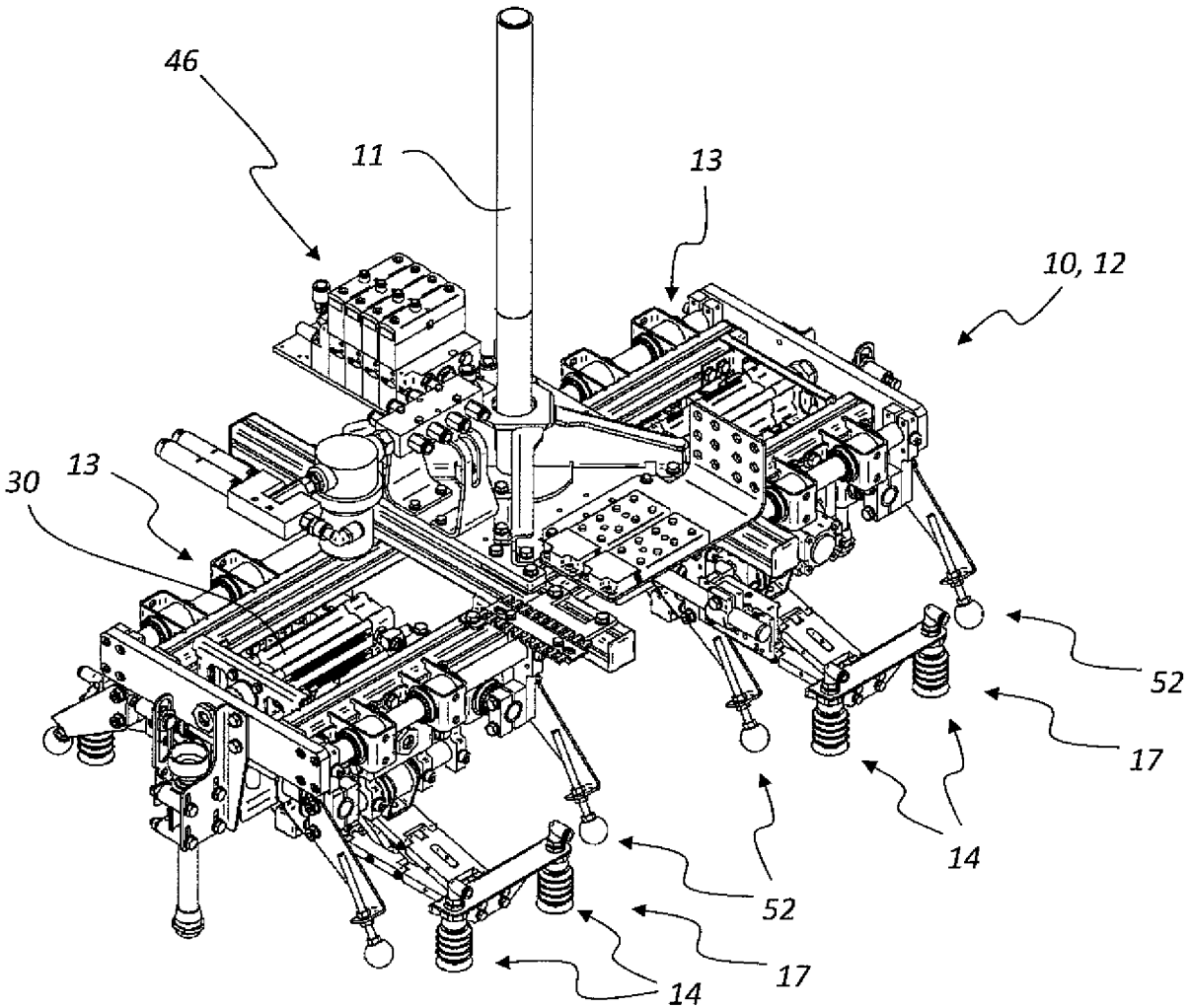
FIG. 9 shows a schematic perspective view of another embodiment of the receiving, holding and/or handling device for two-dimensional objects.
Figure 10:
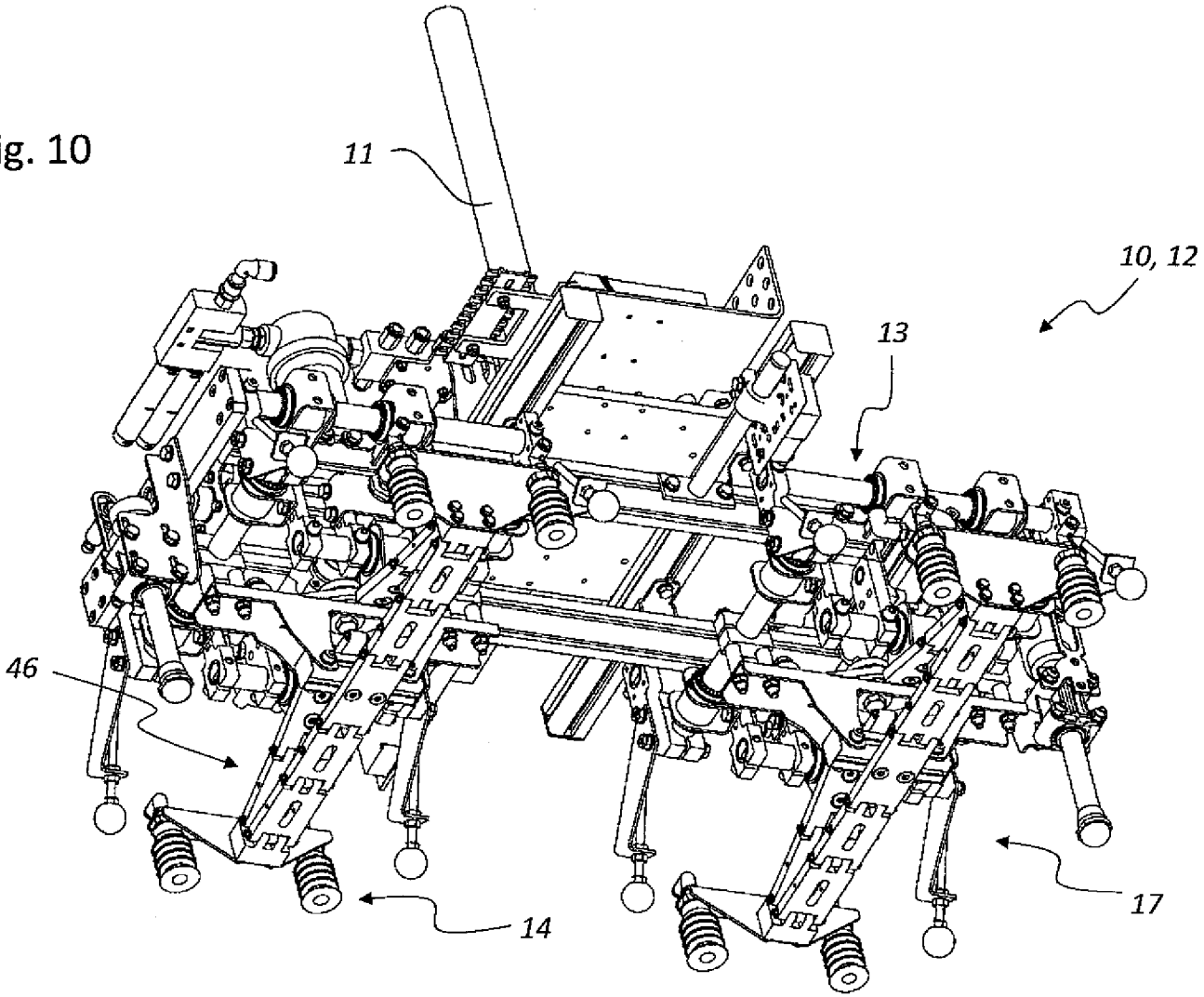
FIG. 10 shows a schematic perspective view of the embodiment of the device of FIG. 9 as seen obliquely from below.

The schematic perspective view in FIG. 9 shows another embodiment of the receiving, holding and/or handling device 10 for two-dimensional objects. The representation shown in FIG. 10 shows a schematic perspective view of the embodiment of the device 10 viewed obliquely from below. Hereby essentially the same components can be seen as in the illustration of FIG. 8. However, the construction of the gripping module 17 differs from the embodiments according to the FIGS. 1 to 8. The gripping module 17 may, for example correspond to the variations shown in FIG. 11 or FIGS. 12 to 15.

In particular, the FIGS. 9 and 10 illustrate an embodiment of the device 10 whereby two similar or identical gripping modules 17 are arranged on a common frame 12. The two gripping modules 17 can be controlled together. This is especially useful when lifting and handling large prefabricated parts or plates. The illustrated embodiment also allows the separate and independent control of the two gripping modules 17. Thereby a separate handling of correspondingly smaller prefabricated parts or smaller prefabricated plates is possible. Especially each smaller prefabricated part can be handled by just one gripping module 17 with its four movable suction grippers 14. Optionally only one gripping module 17 can be activated when smaller components are handled, for instance when intermediate layers for half pallets are handled. The other gripping module 17 remains at rest as long as it is not needed.

In the embodiments of the device according to the invention as shown in FIGS. 9 and 10 the distance between the two gripping modules 17 is adjustable. This is possible because both gripping modules 17 are suspended from slide guides 13 arranged on the common frame 12. The slide guides 13 comprise a pair of horizontal axes for each gripping module 17. The mounting sections or upper suspension parts of the gripping modules 17 together with the driving unit and the control unit are arranged on the axes and are horizontally slidable along the axes of the slide guides 13. Thereby each gripping module 17 together with its entire suspension unit and drive unit can be moved about a certain distance along the frame 12 in a horizontal direction. The gripping module 17 can then be fixed in this new position. By this the two gripping modules 17 can be controlled independently. Furthermore the two gripping modules 17 can be adjusted to different sizes of intermediate layers for half pallets or to different sizes of other two dimensional objects 38.

The above-mentioned adjustment or distance variation of the gripping modules 17 can either be done manually or mechanically, for example, via an electric drive, a pneumatic drive or any other fluid drive.

The tactile elements 52 arranged on both sides of the suction grippers 14 also serve as hold-down elements. The duplicate tactile elements 52 are arranged in pairs. Because of their association with the gripping modules 17, the position of the tactile elements 52 can be adjusted together with the position of the gripping modules 17. The tactile elements 52 or hold-down elements serve to facilitate the separation of the two-dimensional objects 38 before lifting, for example the separation of intermediate layers of plastic or cardboard or they facilitate the separation of intermediate layers for half pallets before lifting.

Figure 11:
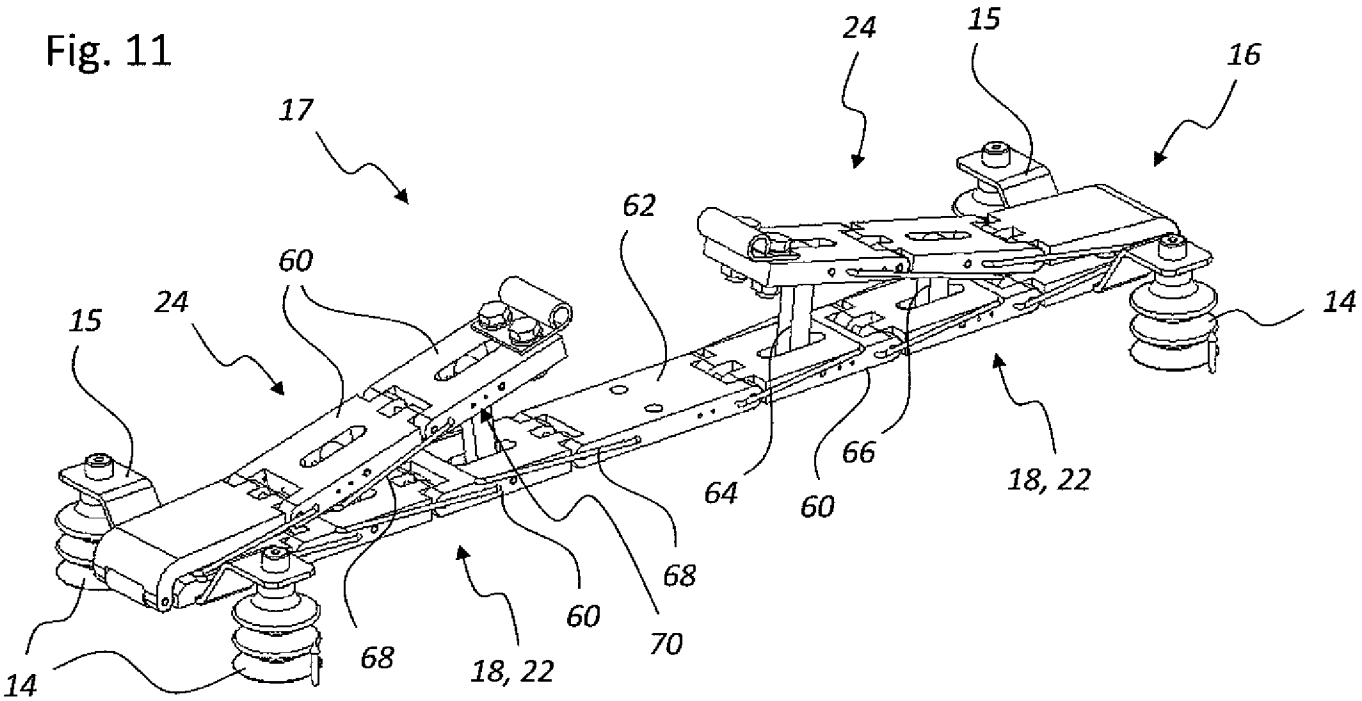
FIG. 11 shows a detailed perspective view of an embodiment of a functional component or a gripping module of the receiving, holding and/or handling device for two-dimensional objects according to the invention.

FIG. 11 furthermore shows a detailed perspective view of an embodiment of a gripping module 17 of the receiving, holding and/or handling device 10 for two-dimensional objects according to the invention. The term two-dimensional object refers to layers of material, whereby the thickness of the material is negligible in comparison to the length and width of the material. The term especially refers to intermediate layers made from film, paper or any other material with similar properties, especially to any flexible material with a negligible thickness. The term comprises cardboard sheets, plastic sheets or metal sheets or twin-walled sheets made of plastic or cardboard, which are used, for instance, as intermediate layers arranged between layers of beverage containers that are stacked on pallets.

The components of the device 10 not shown in FIG. 11 correspond to the components of the embodiments shown in FIGS. 1 to 8 or 9 and 10. This embodiment also comprises four controllable suction grippers 14. The suction grippers 14 are horizontally aligned in a resting position and are therefore ready to receive horizontally disposed sheets or two-dimensional objects (not shown) from a stack. The four suction grippers 14 are each located pair wise at the free ends 16 of the articulated movable and deformable cantilever arms 18. The cantilever arms 18 are mounted and fixed in a symmetrical arrangement on a bridge 20 (see FIGS. 2 and 3) or the cantilever arms 18 are just supported on the bridge 20 and/or arranged in a flying mount (see FIGS. 4 and 5).

In this embodiment the cantilever arms 18 of the gripping module 17 are not elastically deformable. Instead the cantilever arms 18 are made of several rigid plate segments 60 interconnected by articulated joints. The interacting plate segments 60 allow a similar movement of the cantilever arms 18 as shown in the previously described embodiments. The defined and superimposed lifting movements and pivoting movements according to FIG. 11 can be achieved by articulated movements of the plate segments 60. The symmetrically arranged and wing-like cantilever arms 18 each include a horizontally disposed, two-dimensional or sheet-like lower pull 22 and one upper pull 24 inclined from the horizontal at an acute angle. The upper pull 24 is also formed two-dimensional or sheet-like. The lower pull 22 and the upper pull 24 meet at the free end 16 of the cantilever arm 18 and are connected by an articulated joint as shown in the embodiment of FIG. 11. All existing articulated joints between the pivotally interconnected plate segments 60 allow only swiveling movements about parallel axes. The parallel axes are oriented horizontally and transverse to the longitudinal extension direction of the lower pull 22.

The entire lower pull 22 extends over two articulated movable, symmetrical cantilever arms. According to the shown embodiment the entire lower pull 22 is formed by seven interconnected plate segments 60. Each upper pull 24 is formed by three plate segments 60, which are interconnected by articulated joints. Of course other arrangements are conceivable, whereby the lower pull 22 is formed by more than seven or less than seven plate segments 60 and whereby the upper pull 24 is formed by more than three or less than three plate segments 60. The central plate segment 62 of the lower pull 62 can be shorter or longer than the neighboring plate segments 60, if required. The central segment 62 can optionally be anchored to the bridge 20 of the device 10 (see FIG. 1, FIG. 8), screwed to the bridge 20 or supported on the bridge 20 in a flying mount.

The two plate segments neighboring the central plate segment 62 of the lower pull 22 are each connected via an articulated joint to the inner plate segments 60 of the upper pulls 24 by first coupling rods 64. The subsequently neighboring plate segments 60 of the lower pull 22 are each connected via an articulated joint to the middle plate segments 60 of the upper pulls 24 by second coupling rods 66. The outermost plate segments 60 of the upper pulls 24 and the outermost plate segments 60 of the lower pull 22 are each interconnected via articulated joints at the free ends 16 of the cantilever arm. The two inner first coupling rods 64 are each longer than the two outer second coupling rods 66. Thereby a wing-like arrangement is formed as shown in FIG. 11. The contour of this arrangement is not significantly different from the embodiments described before. The functionality and positioning of the coupling rods corresponds mainly to the functionality and positioning of the connecting bars 25 described before. A main difference is that the coupling rods 64 and 66 are not mounted rigidly but on pivot pins as can be seen in FIG. 11. Therefore the coupling rods 64 and 66 are connected to the relevant plate segments of the upper pull 24 or the lower pull 22 by articulated joints.

Some or each of the joints in between the plate segments 60 and 62 can comprise spring elements. This in indicated in FIG. 11 by spring bands 68, which are formed rather thin and which partially enclose the plate segments 60 and 62. The spring bands 68 couple the plate segments 60 and 62. The spring bands 68 especially couple the movement of the plate segments 60 and 62. The plate segments 60 and 62 are not fully and freely movable about the respective connecting axis. Instead they return into their original or initial position as represented in FIG. 11. In this original or initial position the lower pull 22 extends approximately straight and without any curvature. The U-shaped spring bands 68 are specially designed and mounted. The base section of the spring bands 68 lie flatly on the upper side of a plate segment 60 and/or are hooked to the upper side of a plate segment 60. The spring bands 68 each comprise two parallel legs that are arranged rectangular to the base section. The free ends of the legs are formed as angled hooks, which can be hooked into corresponding receiving openings 70 at the sides of neighboring plate segments 60. Each plate segment 60 comprises three or four receiving openings 70 arranged beside each other. This allows a displacement of the spring bands 68, whereby a variation of the restoring forces acting between the plate segments 60 and 62 is possible. A variation of the spring forces and the restoring forces can also be achieved by the use of spring bands 68 of different strength.

In the lower pull 22 the base section of each spring band 68 lies on the upper side of each neighboring outer plate segment 60. If a plate segment 60 gets pulled upwards, a downward acting restoring force is created. The hook-shaped ends of the spring band 68 legs are hooked to the opposite sides of the subsequently arranged inner plate segments 60 or the central plate segment 62. The appropriate orientation of the spring bands 68 in the upper pulls 24 depends on the desired direction of the restoring forces. Optionally, the hook-shaped ends of the parallel legs can be anchored to the sides of the plate segments 60 in such a manner that they can not twist in the receiving openings 70. Thereby the desired restoring action of the spring elements is achieved Other spring elements can be used to achieve the spring forces between the plate segments, which are connected by articulated joints. For instance laminated spring elements integrated into the articulated joints or elastic pins integrated between the plate segments 60 or other suitable means can be used.

The respective suction grippers 14 are arranged pair wise beside each other at the free ends 16 of the cantilever arms 18. The connection between the suction grippers 14 and the free ends 16 is not articulated but rigid. The grippers 14 are connected to the free ends 16 by a mounting plate 15 that is attached to the outermost plate segment 60 of the lower pull 22.

As in the embodiments described above but not shown in FIG. 11, a pulling means or actuating means for generating a horizontally oriented pulling force is assigned to each of the upper pulls 24 of each cantilever arm 18, whereby the force is approximately parallel to the longitudinal extension direction of the respective cantilever arm 18. Normally the two actuating means work synchronously against each other.

Figures 12, 13:
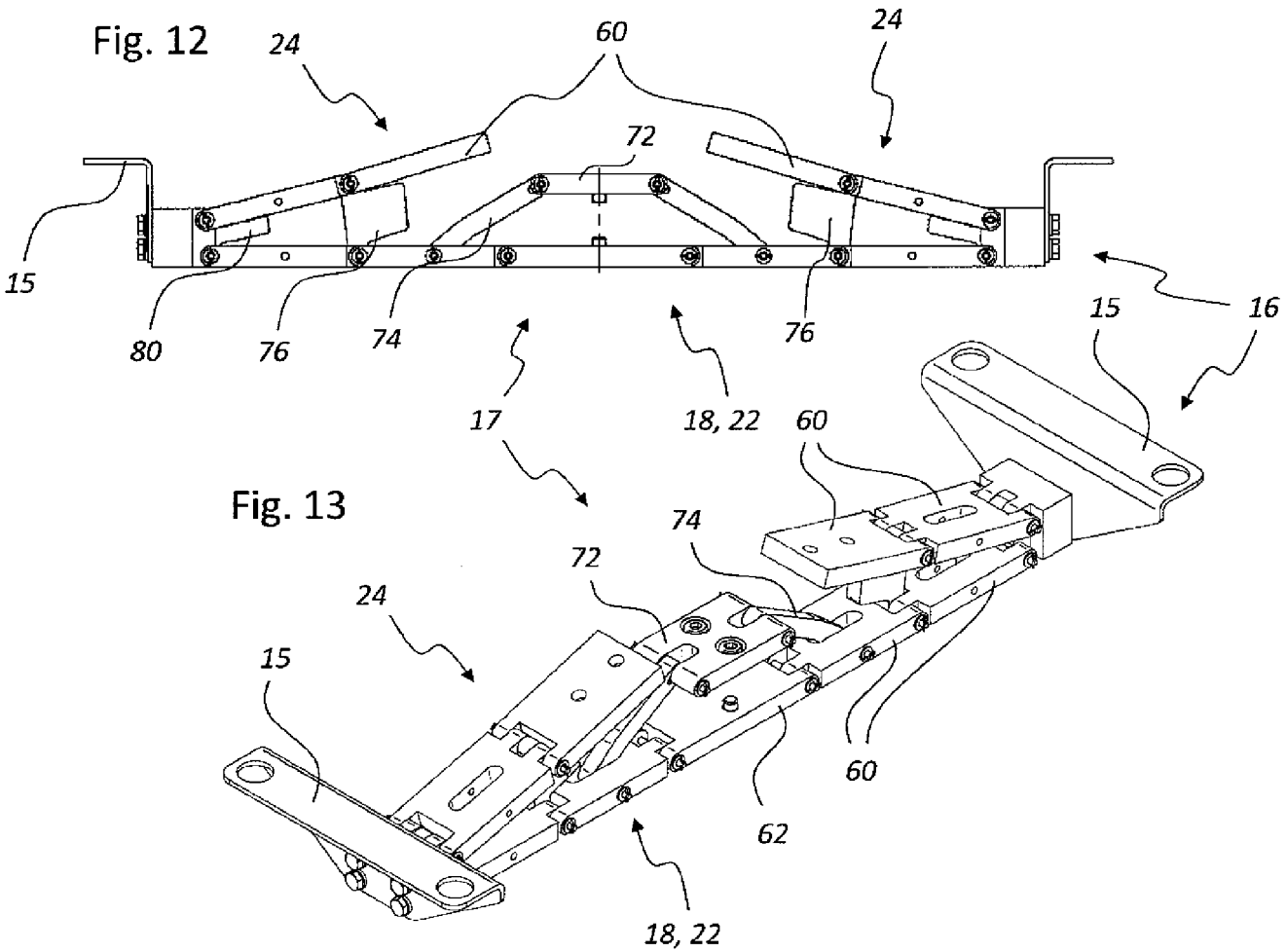
FIG. 12 shows a schematic side view of a gripping module of the variation of the device according to FIG. 9.
FIG. 13 shows a schematic perspective view of the gripping module according to FIG. 12.

The side view of FIG. 12 and the perspective view of FIG. 13 show another embodiment of the gripping module 17 of the device 10 according to the invention. The components of the device 10 that are not shown in FIGS. 12 and 13 can correspond to the components shown in the embodiments of FIG. 1 and 8 or 9 and 10. For instance, the suction grippers attached pair wise to the free ends 16 of the cantilever arms 18 of the gripping module 17 are not shown here. The suction grippers are mounted to L-shaped mounting plates 15. The front of the vertical section of the mounting plate 15 is connected to the free end 16 and the upper surface of the mounting plate 15 is mounted perpendicular to the longitudinal extension direction of the cantilever arms 18. A vertically angled section of the mounting plate 15 shows a horizontal orientation in a resting position of the gripping module 17. In this resting position the cantilever arm 18 are not raised. The vertically angled section comprises two mounting holes for the attachment of the suction grippers. The two mounting holes are spaced apart from each other. The articulated movable and deformable cantilever arms 18 are symmetrically arranged and mounted on a bridge 20 and fixed to the bridge 20 (see FIGS. 2 and 3). The cantilever arms 18 can also just be supported on the bridge in a flying mount (see FIGS. 4 and 5). In this embodiment of the gripping module 17 the cantilever arms 18 are not elastically deformable. Instead the cantilever arms 18 are made of several rigid plate segments 60 that are interconnected by articulated joints. The interaction of the plate segments 60 allows a similar movement of the cantilever arms as shown in the embodiments described before. The cantilever arms 18 can perform defined and superimposed lifting movements and the swiveling movements according to FIGS. 12 and 13 by performing articulated movements of the plate segments 60. The symmetrically arranged and wing-like cantilever arms 18 each include a horizontally arranged planar or sheet-like lower pull 22 and an upper pull 24, which is inclined from the horizontal plane at an acute angle. The upper pull 24 is also formed planar or sheet-like. The lower pull 22 and the upper pull 24 meet at the free end 16 of the cantilever arm 18. According to the embodiment shown in FIGS. 12 and 13 the lower pull 22 and the upper pull 24 are connected at the meeting point by an articulated joint. All articulated joints between the interconnected swivel mounted plate segments 60 only allow swivel movements around parallel axes, whereby the parallel axes are each oriented horizontally and transverse to the longitudinal extension direction of the upper pull 22.

The entire lower pull 22 extends over the two articulated movable, symmetrical cantilever arms 18. According to the shown embodiment the entire lower pull 22 is formed by five interconnected plate segments 60. Each of the two upper pulls 24 is formed by two plate segments 60, which are interconnected by articulated joints. The central plate segment 62 of the lower pull 22 can be shorter or longer than the neighboring two plate segments 60 if required. The central segment 62 can optionally be anchored to the bridge 20 of the device 10 (see FIG. 1, FIG. 8), screwed to the bridge 20 or supported on the bridge 20 in a flying mount. In the embodiment shown in FIGS. 12 and 13 the support on the bridge 20 is done via an additional bridge segment 72. The additional bridge segment 72 is arranged above and in parallel to the central plate segment 62 of the lower pull 22. The additional bridge segment 72 is supported via two symmetrical oblique coupling rods 74—furthermore referred to as third coupling rods 74—on the two plate segments 60 of the lower pull 22, which are arranged on both sides of the central plate segment 62 of the lower pull 22. The two third coupling rods 74 incline downwards on either side of the bridge segment 72 and are both mounted on both sides of the segments 72 and 60 in articulated joints.

The two plate segments 60, adjoining the central plate segment 62 of the lower pull 22 on both sides, are interconnected to the plate segments 60 of the upper pulls 24 by fourth coupling rods 76. The fourth coupling rods 76 are articulated connected to the outer articulated joints, which are located between the plate segments 60 adjoining the central plate segment 62 of the lower pull 22 and the outermost plate segments 60 of the lower pull 22 as can be seen in FIG. 12. The fourth coupling rods 76 furthermore show a plane or two-dimensional profile. This profile provides a movement stop for the deformation or curvature of the gripping module 17 in the manner shown in FIG. 3 or FIG. 5. Such movement stops or stopping profiles 80 are also provided at the free ends 16. They extend into the inner space between the outer plate segments 60 of the upper pulls 24 and the outer plate segments 60 of the lower pull 22. Thereby they also provide a limitation for the curvature of the gripping module 17. Altogether the gripping module 17 shows a wing-like shape according to FIG. 12. The contour of this arrangement is not significantly different from the embodiments described before. The functionality and positioning of the coupling rods 76 corresponds mainly to the functionality and positioning of the connecting bars 25 described before. A main difference is that the coupling rods 76 are not mounted rigidly. Instead they are mounted in the articulated joints between the plate segments 60 as can be seen in FIGS. 12 and 13. Therefore the coupling rods 76 are connected to the respective plate segments 60 of the upper pull 24 or the lower pull 22 by articulated joints.

Each of the two upper pulls 24 of the respective cantilever arm 18 comprises a pulling means or an actuating means for generating a horizontally directed pulling force approximately parallel to the longitudinal extension of the cantilever arm 18. This has been shown for the embodiments described previously, but is not shown in FIGS. 12 and 13.

Other embodiments not shown here are also possible, whereby the upper pulls 24 are made from ropes, belts, link chains or the like. The upper pulls 24 can either be connected to the lower pull 22 elastically or by articulated joints or at least partially rigid.

Figure 14:
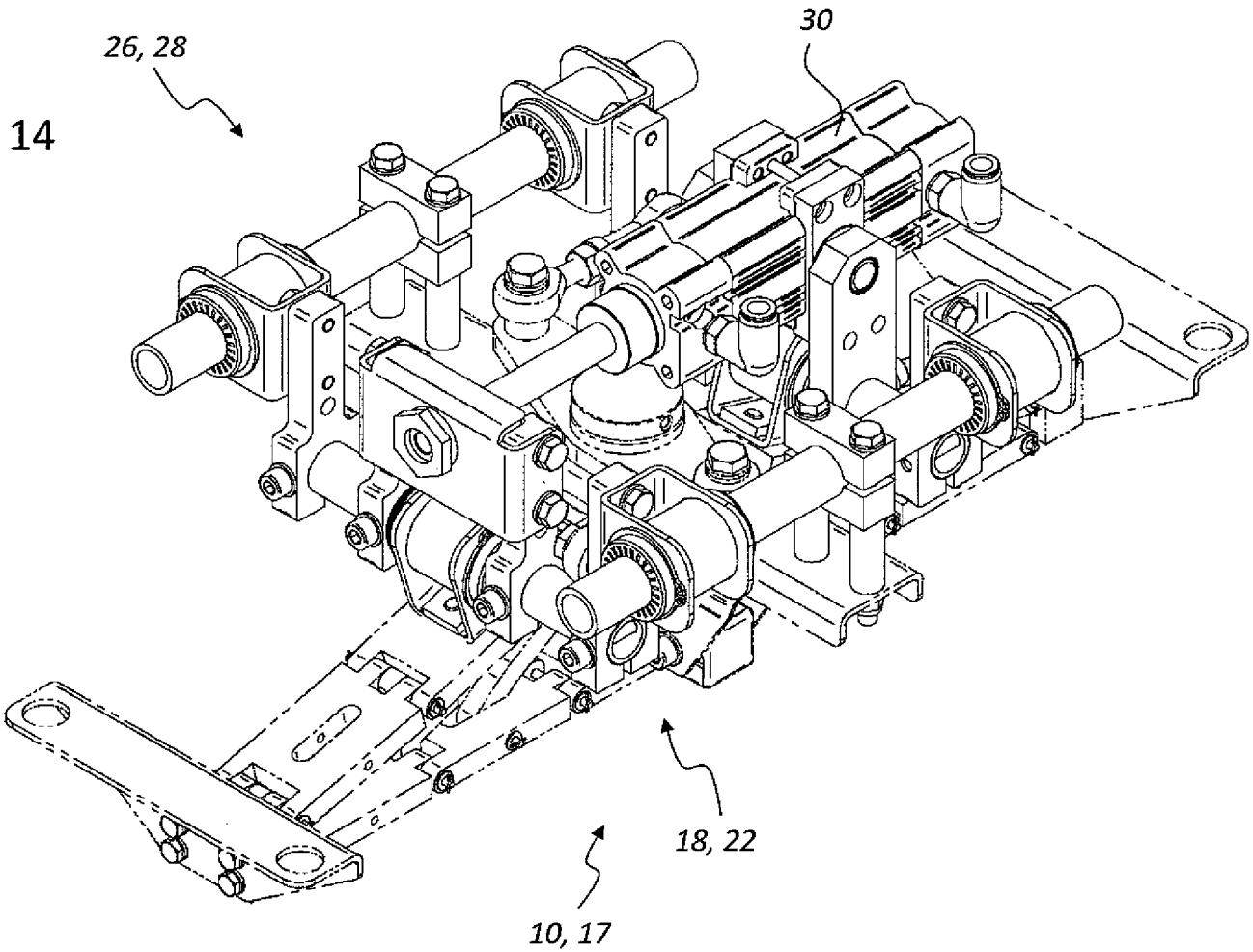
FIG. 14 shows a schematic perspective view of a part of the device according to FIG. 9 with actuators for the actuation and movement of the gripping module according to FIG. 12 and FIG. 13.
Figure 15:
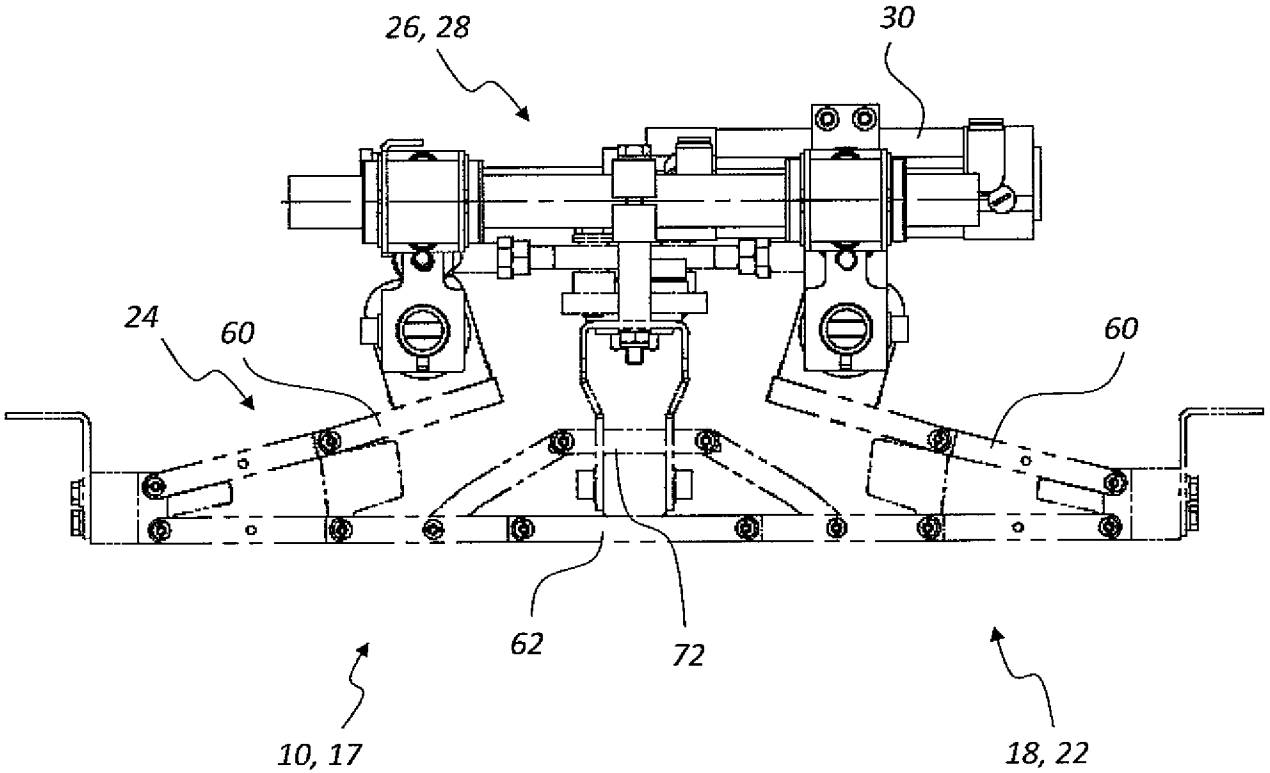
FIG. 15 shows a schematic side view of the representation according to FIG. 14.

The schematic perspective view of FIG. 14 shows a part of the device according to FIG. 9 with actuators for the actuation and movement of the gripping module 17 as can be seen in FIG. 12 and FIG. 13. FIG. 15 shows a schematic side view of the representation of FIG. 14. FIG. 15 especially shows the deformation of the gripping module 17. This is achieved by an interaction of the linear drive 30 with the actuating means 26 and pulling means 28. Thereby pulling movements are exerted onto the inner plate segments 60 of the upper pulls 24. This leads to the desired actuation of the gripping module 17. The bridge segment 72 together with the central plate segment 62 is supported in the middle. Thereby the free ends 16 together with the attached mounting plates 15 and the attached suction grippers 14 can each pivot in an upward direction.

Figure 16:
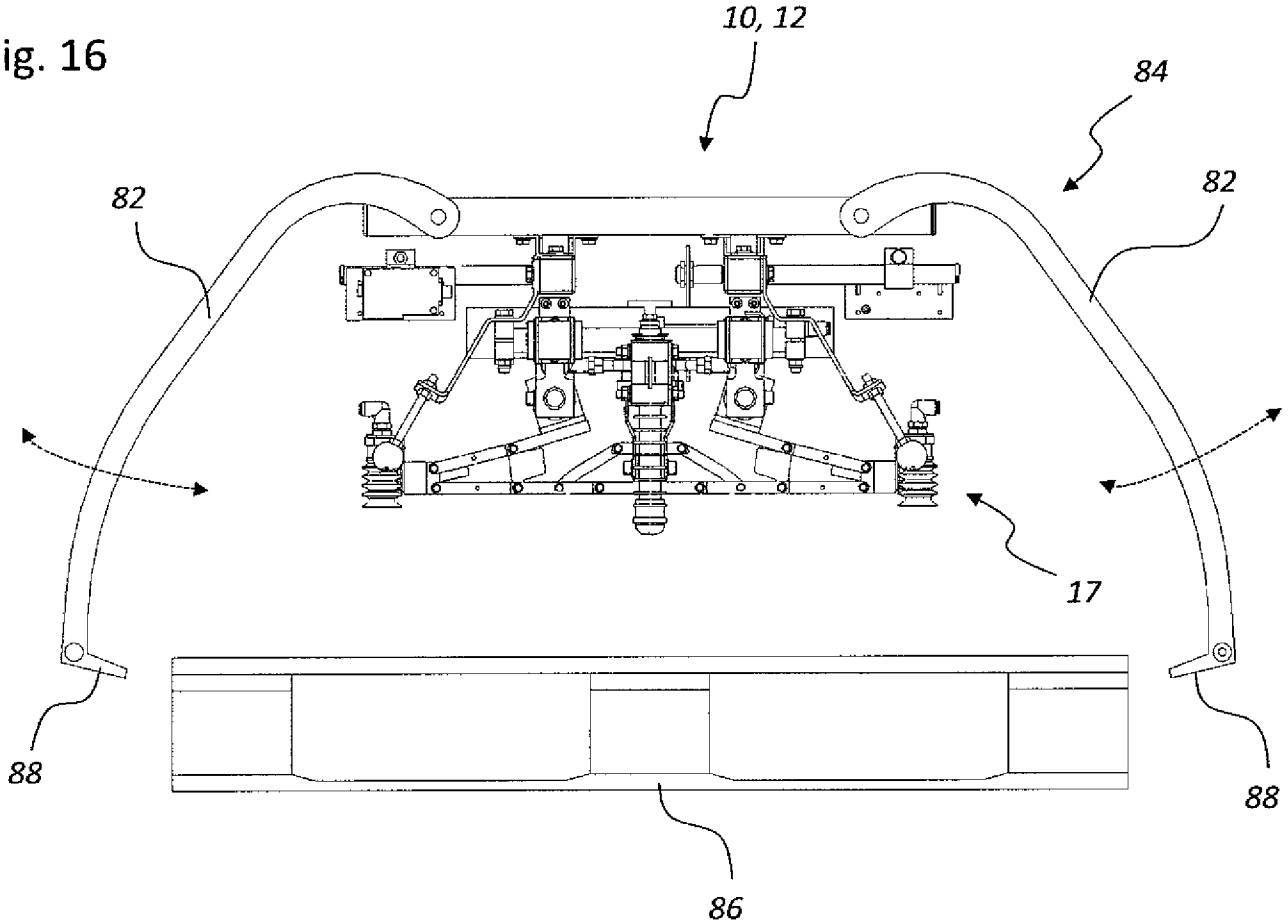
FIG. 16 shows a further embodiment of a device according to the invention with an additional pallet gripping system
Figure 17:
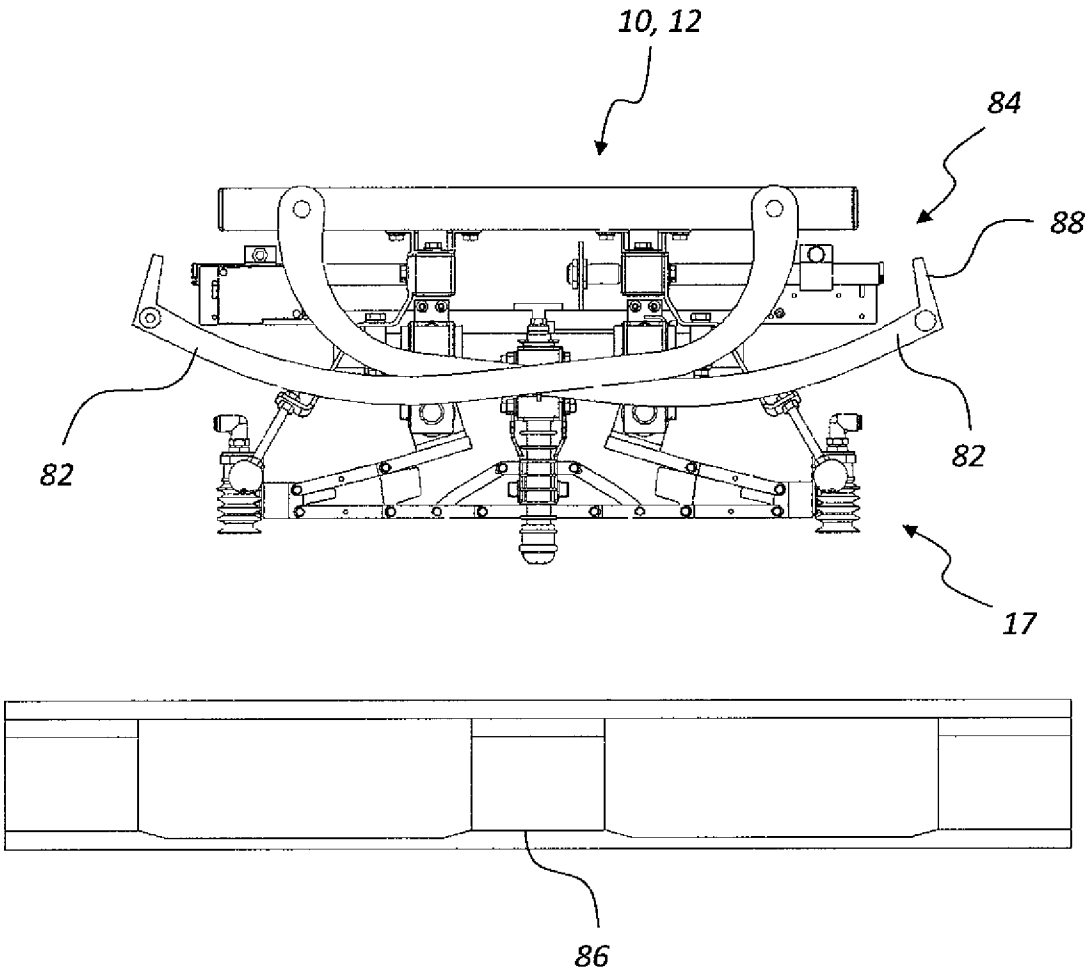
FIG. 17 shows the device according to FIG. 16 with a deactivated pallet gripping system.

An embodiment depicted in FIGS. 16 and 17 has pivotable gripping arms 82, which are arranged above the gripping module 17 and which act as grippers for intermediate layers or as pallet grippers. The two gripping arms 82 are symmetrically movable and linked to the frame 12 above the gripping module 17. The two gripping arms 82 encompass the gripping module 17 from two sides and form an optional pallet gripping system 84. The pallet gripping system 84 can be combined advantageously with the device 10 according to the invention. The pallet gripping system 84 can grab a pallet 86 located below the gripping module 17. Hereby it is irrelevant if the gripping module 17 is in an active state or in an inactive state. The ends of the gripping arms 82 are formed as hooks 88 that face each other. The pallet 86 is gripped and fixed by these hooks 88 as shown schematically in FIG. 16. Optionally the gripping arms 82 of the pallet gripping system 84 can work independently of the gripping module 17, whereby only the pivoting movements and the actuating movements are coupled to the frame 12.

If the gripping arms 82 are not in use, they can either be at least partially intertwined as shown in FIG. 17 or the gripping arms 82 are tilted upward towards the frame 12. This ensures a sufficient distance to the height level of the required working space of the gripping module 17. If the pallet gripping system is stowed away like this, the gripping module 17 can be used for receiving two-dimensional objects 38 as described before without being hindered by the gripping arms 82.

Figure 18:
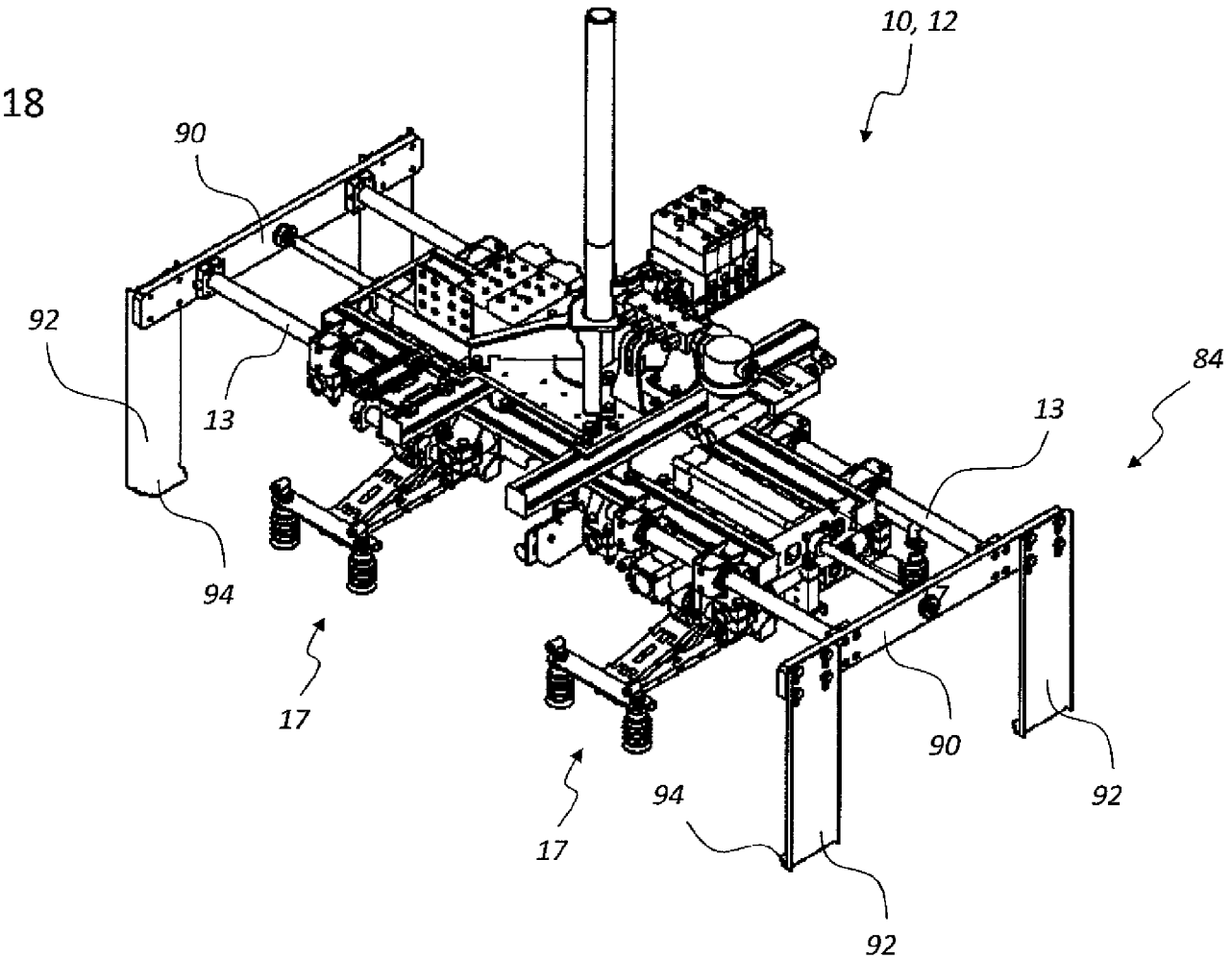
FIG. 18 shows a schematic perspective view of a further variation of the device according to the invention with a pallet gripping system.

The schematic perspective view of FIG. 18 shows another embodiment of the device 10 according to the invention, whereby the device 10 comprises a pallet gripping system 84 which can be combined with the slide guide 13 used for the distance variation of the two gripping modules 17 (see FIG. 9 and FIG. 10). The shown pallet gripping system 84 is combined with the distance variable pair wise arranged gripping modules 17 and uses an extension of the already available slide guide adjustment systems 13 that comprise adjustable mounting plates 90 arranged at the ends. The distance between the mounting plates 90 can be adjusted. The mounting plates 90 comprise metal clips 92 facing vertically downwards. The metal clips 92 each comprise hooks 94 at their bottom side which face inwards, especially which face each other and serve by engaging with the pallet, thereby gripping and handling the pallet.

Basically other variations of gripping systems are conceivable, which are covered by the inventive concept. Especially other variations apart from the pivotable pallet gripping systems 84 (FIG. 16, FIG. 17) or the linearly movable pallet gripping systems 84 (FIG. 18) are conceivable. Generally it should be mentioned that the invention has been described with reference to several different embodiments. To the expert it is also conceivable, however, to make changes and modifications without leaving the scope of protection of the appended claims.

LIST OF REFERENCE NUMBERS

10 Device
11 Column
12 Frame
13 slide guide
14 suction gripper
15 mounting plate
16 free end
17 gripping module
18 cantilever arm
20 Bridge
22 lower pull
24 upper pull
25 connecting bar
26 actuating means
28 pulling means
30 linear drive
32 rod drive
34 cross strut
36 Plate
38 two dimensional object
40 Stack
42 peripheral area
44 central area
46 control unit
50 further cross strut
52 tactile element
54 rigid connection
56 articulated connection
58 composite compound
60 plate segment
62 central plate segment
64 first coupling rod
66 second coupling rod
68 spring band
70 receiving opening
72 bridge segment
74 third coupling rod
76 fourth coupling rod
78 flat profile, stop profile
80 stop profile
82 gripping arm
84 pallet gripping system
86 Pallet
88 Hook
90 mounting plate
92 metal clip
94 Hook

What is claimed is:

1. A receiving, holding or handling device for two-dimensional objects comprising:

at least two controllable suction grippers;

movable cantilever arms, each having a free end, the suction grippers arranged and connected to the free ends, the cantilever arms articulated to be movable at least in some sections;

the cantilever arms supported on a bridge, the cantilever arms each comprising at least one lower pull and one upper pull meeting and connected at the free end, an upward movement of the suction grippers creating a convex curvature of the lower pull; and a puller assigned to at least the upper pull, the puller generating a pulling force with at least one horizontal direction component approximately parallel to a longitudinal extension direction of the cantilever arm.

2. The device as recited in claim 1 wherein at least the upper pulls of the cantilever arms are mounted at a distance from each other in the area of the bridge.

3. The device as recited in claim 1 wherein the lower pulls of aligned cantilever arms are interconnected or the lower pulls of aligned cantilever arms are formed continuously or as a single piece and the lower pulls are supported on the bridge.

4. The device as recited in claim 1 wherein a connective joint between the upper pull, the lower pull and at least one suction gripper of one of the cantilever arms is formed to be bending resistant or rigid.

5. The device as recited in claim 1 wherein a connective joint between the upper pull, the lower pull and at least one of the suction grippers of one of the cantilever arms is formed articulated.

6. The device as recited in claim 1 wherein the suctions grippers are vertically aligned in a first position, and define an arcuate trajectory when the puller is operated, the puller being associated with the upper pulls of the cantilever arms, and the suctions grippers being simultaneously angularly adjustable.

7. The device as recited in claim 1 wherein the upper pull and the lower pull of each cantilever arm are interconnected between the bridge and the free end by at least one connecting bar, the at least one connective joint between the at least one connecting bar and the lower pull is formed articulated and at least one connective joint between the at least one connecting bar and the upper pull is formed articulated.

8. The device as recited in claim 1 wherein two or more connecting bars are arranged between the upper pull and the lower pull, connective joints between the connecting bars and the upper pull or between the connecting bars and the lower pull are formed articulated.

9. The device as recited in claim 1 wherein at least sections of the lower pulls or upper pulls are each formed of several parts and are formed by plate segments interconnected by articulated joints.

10. The device as recited in claim 9 wherein connecting bars between the plate segments are formed by coupling rods connected to the plate segments by articulated joints.

11. The device as recited in claim 10 wherein at least some of the coupling rods are formed as movement stops defining a maximum deformation of the cantilever arms.

12. The device as recited in claim 1 wherein at least parts of the cantilever arms are formed as an integrated voluminous component.

13. The device as recited in claim 12 wherein the integrated voluminous component is a composite component with defined elastic properties or as a composite component with different elastic properties in different parts.

14. The device as recited in claim 1 wherein the puller is formed by horizontally acting linear drives supported on the bridge.

15. The device as recited in claim 1 further comprising at least two gripping modules suspending from a common carrier element, a distance between the two gripping modules being adjustable or the two gripping modules being each controllable and movable independently.

16. The device as recited in claim 1 further comprising a pallet gripping system, the pallet gripping system arranged on a frame comprising at least one controllable gripping module and the pallet gripping system being individually controllable and or pivotable independently of the gripping module.

17. A method for receiving, holding or handling two-dimensional objects with at least two controllable suction grippers, the suction grippers being arranged and connected to free ends of movable cantilever arms, the cantilever arms being pivotally movable at least in some sections and the cantilever arms being supported on a bridge, the cantilever arms each comprising at least one lower pull and one upper pull that meet and are connected at the free end of the cantilever arm by an articulated connection, at least the upper pulls being mounted at a distance from each other in the area of a bridge, the lower pull being connected to the bridge at a defined position supported, the method comprising:

moving the upper pull by a puller with at least one horizontal direction component approximately parallel to a longitudinal extension direction of the cantilever arm; and an upward movement of the suction grippers creating a convex curvature of the lower pull.

* * * * *